US008047641B2

(12) United States Patent
Nanjo et al.

(10) Patent No.: US 8,047,641 B2
(45) Date of Patent: Nov. 1, 2011

(54) LIQUID CONTAINER

(75) Inventors: Tatsuo Nanjo, Kawasaki (JP); Yasuo Kotaki, Yokohama (JP); Tetsuya Ohashi, Matsudo (JP); Koichi Kubo, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 486 days.

(21) Appl. No.: 12/345,662

(22) Filed: Dec. 30, 2008

(65) Prior Publication Data

US 2009/0179979 A1 Jul. 16, 2009

(30) Foreign Application Priority Data

Jan. 10, 2008 (JP) ..... 2008-003496

(51) Int. Cl.
*B41J 2/175* (2006.01)

(52) U.S. Cl. ..... 347/86

(58) Field of Classification Search ..... 347/86
See application file for complete search history.

(56) References Cited

U.S. PATENT DOCUMENTS

| | | | | |
|---|---|---|---|---|
| 5,280,300 | A | 1/1994 | Fong et al. | 346/1.1 |
| 5,440,333 | A | 8/1995 | Sykora et al. | 347/87 |
| 6,168,267 | B1 | 1/2001 | Komplin | 347/86 |
| 6,281,911 | B1 * | 8/2001 | Nakazawa et al. | 347/36 |
| 6,773,099 | B2 | 8/2004 | Inoue et al. | 347/86 |
| 6,830,324 | B2 | 12/2004 | Ogura et al. | 347/86 |
| 6,854,836 | B2 | 2/2005 | Ishinaga et al. | 347/85 |
| 6,935,739 | B2 | 8/2005 | Inoue et al. | 347/104 |
| 6,959,984 | B2 | 11/2005 | Ogura et al. | 347/86 |
| 6,969,161 | B2 | 11/2005 | Kuwabara et al. | 347/85 |
| 6,976,753 | B2 | 12/2005 | Kuwabara et al. | 347/86 |
| 7,077,514 | B2 | 7/2006 | Inoue et al. | 347/86 |
| 7,104,640 | B2 | 9/2006 | Ogura et al. | 347/86 |
| 7,360,876 | B2 | 4/2008 | Inoue et al. | 347/85 |
| 2006/0119676 | A1 * | 6/2006 | Ogura et al. | 347/86 |
| 2007/0052769 | A1 | 3/2007 | Kubo et al. | 347/85 |
| 2007/0171263 | A1 | 7/2007 | Inoue et al. | 347/74 |
| 2008/0062231 | A1 | 3/2008 | Kubo et al. | 347/86 |

FOREIGN PATENT DOCUMENTS

| | | |
|---|---|---|
| JP | 60-151055 | 8/1985 |
| JP | 6-226993 | 8/1994 |
| JP | 9-123476 | 5/1997 |
| JP | 2007-062337 | 3/2007 |
| JP | 2007-069351 | 3/2007 |

* cited by examiner

*Primary Examiner* — Matthew Luu
*Assistant Examiner* — Lisa Solomon
(74) *Attorney, Agent, or Firm* — Fitzpatrick, Cella, Harper & Scinto

(57) ABSTRACT

This invention provides a highly reliable liquid container without degrading a liquid accommodation efficiency or increasing a substantial cost. When the liquid container is impacted, the liquid container can protect against damage the flexible film that forms the liquid accommodation chamber. The recessed portion is provided on the inner surface of the cover member facing the plate material. Provided at the opening of the recessed portion is the shock absorbing sheet that elastically deforms into the recessed portion when the plate member is impacted.

11 Claims, 24 Drawing Sheets

LIQUID CONTAINER

BACKGROUND OF THE INVENTION

1. Field of the Invention

The present invention relates to a liquid container to accommodate a variety of kinds of liquids, such as printing inks and liquids specially designed to improve ink fixing performance. Such a liquid container may include an ink tank detachably mounted in an ink jet printing apparatus.

2. Description of the Related Art

An ink jet printing apparatus prints an image on a print medium by supplying ink from an ink tank to a print head and ejecting ink from the print head. A so-called serial type ink jet printing apparatus has a carriage mountable a print head and performs printing by ejecting ink onto a print medium from ejection nozzles of the print head mounted on the carriage as the carriage is moved relative to the print medium. A so-called full-line type ink jet printing apparatus uses a print head having ejection nozzles arrayed over a range matching a width of a print medium. The full-line type performs printing by ejecting ink from the ejection nozzles of the print head toward the print medium fed under the print head.

An ink tank for supplying ink to these print heads holds the ink at a predetermined negative pressure. The negative pressure is intended to create a force to hold a meniscus of ink formed in every ejection nozzle of the print head and thereby prevent a possible leakage of ink from the ejection nozzles. The negative pressure is set in an appropriate pressure range that assures an ink ejection operation of the print head.

Among a mechanism for creating such a negative pressure is known a construction in which a porous member such as sponge to soak and hold ink is installed in the ink tank to create an appropriate negative pressure in the tank by an ink holding force generated by the porous member. There is also known a construction in which a bag member, formed of an elastic material such as rubber that produces a tension in a direction that expands its volume, is filled with an ink to apply a negative pressure to the ink by the tension the bag member has produced.

Also known is a construction in which a bag member formed of a flexible film is attached with a spring inside or out-side it to bias the film in a direction that expands the volume of the bag member, thus applying a negative pressure to the ink contained in the bag member. Among the ink tank using this negative pressure mechanism are those described in Japanese Patent Laid-Open No. 2007-069351 and U.S. Pat. No. 6,168,267.

Japanese Patent Laid-Open No. 2007-069351 and U.S. Pat. No. 6,168,267 describe ink tanks 100 constructed as shown in FIG. 22A and FIG. 22B. A case 101 formed with an ink supply port (not shown) is attached with a flexible convex film 102 to form an ink accommodation space 103, in which a spring 104 is installed to generate a negative pressure. A plate member 105 is placed between the film 102 and the spring 104. The case 101 is attached with a cover member 106 that is formed with ribs 106A to restrict the movement of the plate member 105. In the ink tank 100 constructed of the film 102 and the spring 104, the plate member 105 is installed between them to transmit a pressure of the spring 104 to the film 102. The spring 104 and the plate member 105 are secured together by fastening or fusing to prevent positional shift.

The case 101 is preferably formed of the same resin material as the film 102. The ink accommodation space 103 formed by fusing them together is hermetically enclosed except for the supply port. An opening of the supply port is constructed to form therein by the negative pressure created by the spring 104 an ink meniscus of a size that prevents external air from getting into the ink accommodation space 103. For example, a mesh filter for generating an ink meniscus force may be fixed to the supply port.

The ink tank 100 having the ink accommodation space 103 formed of the film 102 as described above has an excellent ink accommodation efficiency, compared with an ink tank that generates a negative pressure as by a sponge soaked with ink.

Japanese Patent Laid-Open No. 2007-069351 also describes a method of forming the film 102 into a convex shape. This method involves first fusing a flat sheet material (a material to be formed into the film 102) to the case 101 of the ink tank and then forming the sheet material into a convex shape. That is, the flat sheet material is directly fused to the case 101 that is used as a forming die for the film 102. More specifically, by heating the sheet material fused to the case 101 and drawing air from between the sheet material and the case 101 by suction, the sheet material is formed into a convex shape conforming to the inner concave surface of the case 101. This obviates a troublesome step of positioning the convex-formed film 102 on the case 101 and allows the sheet material to be formed easily into the convex film 102 conforming to the shape of the case 101. Further, since the film 102, which is relatively difficult to handle, and the case 111 are constructed as one piece, they can be handled easily.

The ink tank 100 with the above negative pressure generation mechanism, when it falls in a direction crossing an expansion and compression direction of the spring 104 (in the direction of arrow in FIG. 22A), the plate member 105 may strongly impact the cover member 106, as shown in FIG. 22B. Since the film 102 between the plate member 105 and the cover member 106 is very thin, about 10-100 μmm thick, it is likely to be damaged by being pinched between them when it falls.

How the film 102 is damaged as a result of fall will be explained by referring to FIG. 22A and FIG. 22B.

The ink tank 100 falls in the direction of arrow crossing the expansion and compression direction of the spring 104 while maintaining the state of FIG. 22A in which it has been before the fall. Then, the instant the ink tank 100 hits the ground, ink contained in the ink tank 100 moves by its inertia in the direction of gravity. At this time, since the impacted part (lower part) of the ink tank 100 is the rigid case 101, the ink rushes to the impacted side of the ink tank 100 and at the same time moves in a direction that the film 102 can be deformed (in the direction of arrow in FIG. 22B). The plate member 105 similarly moves toward the impacted side by the inertia while at the same time a part of the plate member 105 on the impacted side is pushed in the direction of arrow of FIG. 22B by the ink moving toward the film 102 side. As a result, the part of the plate member 105 on the impacted side strikes against the inner surface of the cover member 106. Since this series of motions occurs instantaneously with high energy as the falling ink tank 100 hits the ground, the plate member 105 and the cover member 106 strike each other with force. This strong collision may result in the film 102 interposed between the plate member 105 and the cover member 106 being pinched between them and damaged.

Portions of the convex film 102 that are likely to be damaged are found to be, in particular, those portions 102A corresponding to corner portions 105A of the plate member 105 as shown in FIG. 23. FIG. 23 is a side view of the case 101 with the cover member 106 removed, as seen from the direction of arrow XXIII of FIG. 22A. As described in Japanese Patent Laid-Open No. 2007-069351 and U.S. Pat. No. 6,168,267, the plate member 105 often has a nearly rectangular shape as shown in FIG. 23. At the instant of collision between the roughly rectangular plate member 105 and the cover member 106, the plate member 105 is tilted to project the corner portions 105A causing them to come into point contact with the cover member 106. With stresses concentrated at the point contact portions, the film 102 may be broken at the portions 102A corresponding to the corner portions 105A.

To prevent the film 102 from being damaged easily, Japanese Patent Laid-Open No. H6-226993(1994) proposes a measure that mounts a guard member (shock absorbing material) to the plate member 105 and Japanese Patent Laid-Open No. S60-151055(1985) proposes a measure that places a shock absorbing material between the cover member 106 and the film 102.

In these measures, however, since an impact is absorbed by the shock absorbing material being deflected, to absorb a high energy produced by the impact of the falling ink tank requires increasing the thickness of the shock absorbing material to set the deflection range large. But setting the thickness of the shock absorbing material large limits a range in which the plate member is allowed to move, reducing the ink accommodation space, which in turn is likely to reduce the amount of ink that can be filled into the accommodation space. Another problem is that the shock absorbing material that is thin and still able to absorb shocks is limited to special materials such as silicone gel-like materials. Generally, a material with such a high energy absorbing capability is very expensive and may lead to a substantial increase in cost of the ink tank.

As shown in Japanese Patent Laid-Open No. 2007-069351, when a flat sheet material is formed into a convex film 102 by using a concave die member such as the case 101, the sheet material progressively cools and solidifies as it engages the concave die member. The sheet material finally contacts the bottom surface of the concave die member. The portion of the sheet material that contacts the bottom surface of the concave die member corresponds to the corner portions of the convex film 102. Therefore the corner portions of the film 102 are most stretched and become thin during forming. The corner portions of the film 102 are the portions 102A that also correspond to the corner portions 105A of the plate member 105. This means that the portions 102A of the film 102 are the most easily breakable portions.

When the case 101 is used as a forming die for the film 102, as in the case of Japanese Patent Laid-Open No. 2007-069351, the elongation and thickness of the sheet material depends on the depth of the recessed portion of the case 101. Japanese Patent Laid-Open No. 2007-062337 describes a method of forming the film 102 into a convex shape by using a die that folds the sheet material at half the depth of the recessed portion of the case 101. With this method, a portion of the film 102 at or around the folded part may be elongated so that it can be used as a convex film about two times as high as the depth of the recessed portion of the case 101. This keeps the elongation during forming of the sheet material to as little extent as possible, minimizing the partially thinned portion of the film 102. As a result, the film 102 can be protected against damage.

If an ink tank product with twice the current ink accommodation volume is planned, the ink tank size needs to be increased. To make the ink tank usable in a printing apparatus which is formed compact by reducing its height, it is difficult to increase the height and depth of the ink tank and the only option available is to change the width of the ink tank. The width of the ink tank is in the direction of depth of the case (equivalent to the lateral width of the tank in FIG. 22A), so the recessed portion of the case needs to have nearly two times the current depth. In the convex film forming method disclosed in Japanese Patent Laid-Open Nos. 2007-069351 and 2007-062337, as described above, the elongation and thickness of the sheet material changes with the depth of the recessed portion of the case. The deeper the recessed portion, the thinner the sheet material becomes. Further, since the increased ink tank capacity results in an increase in its weight and therefore an impact at time of fall, which in turn increases a possibility of the film damage.

One possible countermeasure to cope with this problem may involve using the forming method of Japanese Patent Laid-Open No. 2007-062337 and increasing the thickness of a pre-formed sheet material to increase the overall thickness of the entire convex film. However, this approach, although it can make the easily damaged film portions thick, increases the thickness of other portions more than necessary and therefore a film rigidity. As a result, the film behavior is not smooth as the ink in the ink tank is consumed. This in turn raises possibilities of the negative pressure in the ink accommodation space abruptly changing and of the ink in the accommodation space failing to be consumed completely.

Further, Japanese Patent Laid-Open No. H9-123476(1997) discloses a construction in which corner portions of a plate member is rounded to protect possible damages of the film 102. Simply rounding the corner portions of the plate member, however, cannot deal with the characteristic thickness distribution of the convex film formed by a concave forming die, as described later. It is also necessary to reduce the size of the plate member, giving rise to a possibility of the ink accommodation efficiency reducing significantly.

SUMMARY OF THE INVENTION

This invention provides a highly reliable liquid container which, when it is strongly impacted, can prevent a possible damage to a flexible film that forms a liquid accommodation chamber, without causing a reduction in a liquid accommodation efficiency or a significant cost increase.

In the first aspect of the present invention, there is provided a liquid container comprising: a case and a flexible film to form a liquid accommodation chamber capable of accommodating a liquid; a supply port to draw out the liquid from the liquid accommodating chamber; a plate member situated on an inner surface of the film; a spring member to bias the film through the plate member to create a negative pressure in the liquid accommodation chamber; a cover member situated on an outer side of the film; a recessed portion provided on an inner surface on the liquid accommodation chamber side of the cover member opposing the plate member; and a shock absorbing member situated at an opening of the recessed portion and elastically deformable toward an interior of the recessed portion when the plate member is impacted.

With this invention, when the liquid container is strongly impacted, a shock absorbing member absorbs the impact of the plate member by using a recessed inner space in a cover member, so that a flexible film can be protected against being damaged without reducing a liquid accommodation efficiency. Further, with use as a shock absorbing member of a shock absorbing sheet that can easily be laid at a desired position and flexibly conform to the shape of a recessed portion, the manufacturing cost of the liquid container can be minimized.

When the flexible film that forms a liquid accommodation chamber is formed into a convex shape, portions of the plate member facing the thin parts of the film may be provided with a notch to prevent a possible damage of the flexible film more effectively.

Further features of the present invention will become apparent from the following description of exemplary embodiments (with reference to the attached drawings).

DESCRIPTION OF THE EMBODIMENTS

Now, embodiments of the present invention will be described in detail by referring to the accompanying drawings.

First Embodiment

Figure 1:
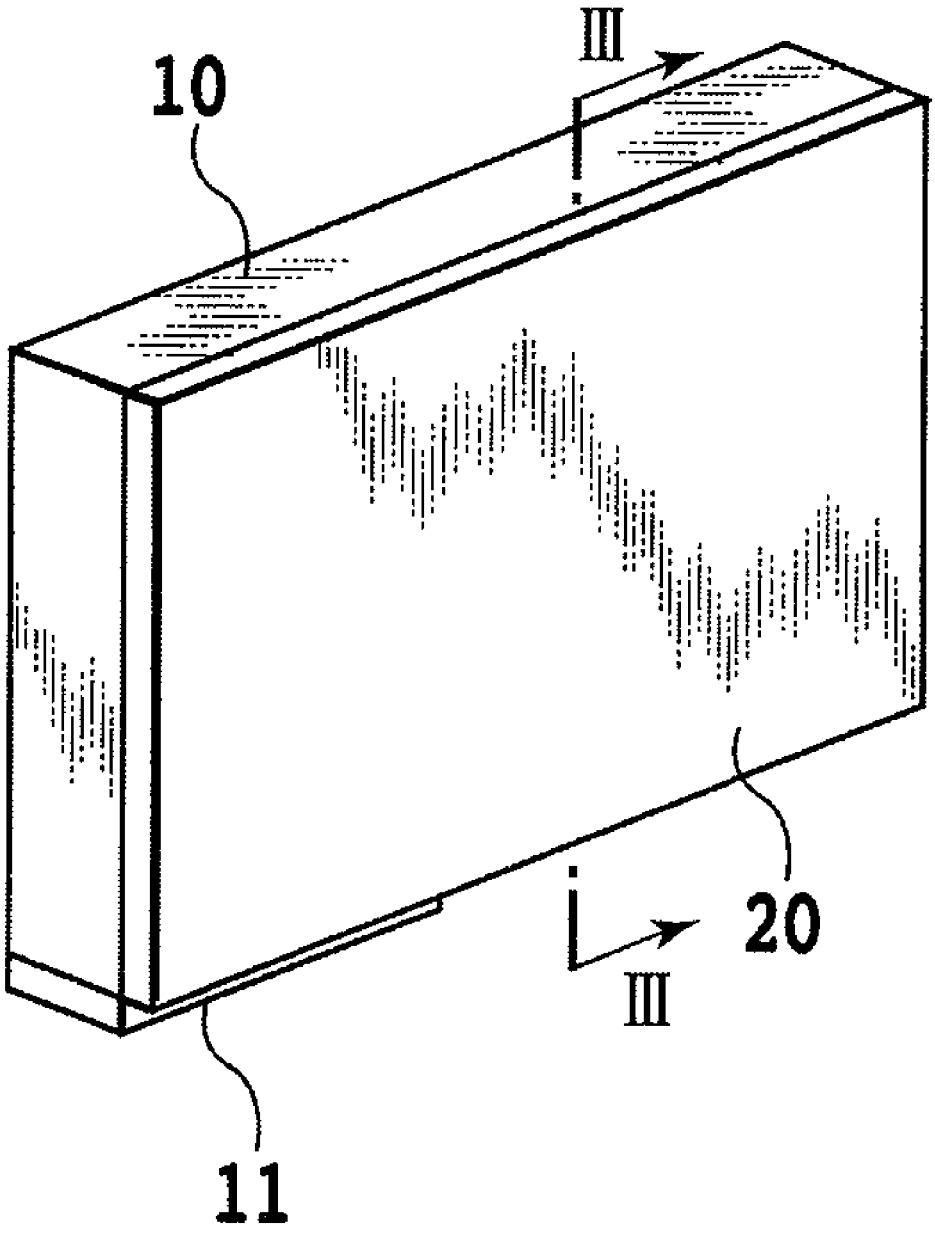
FIG. 1 is an external perspective view of an ink tank in a first embodiment of this invention.
Figure 2:
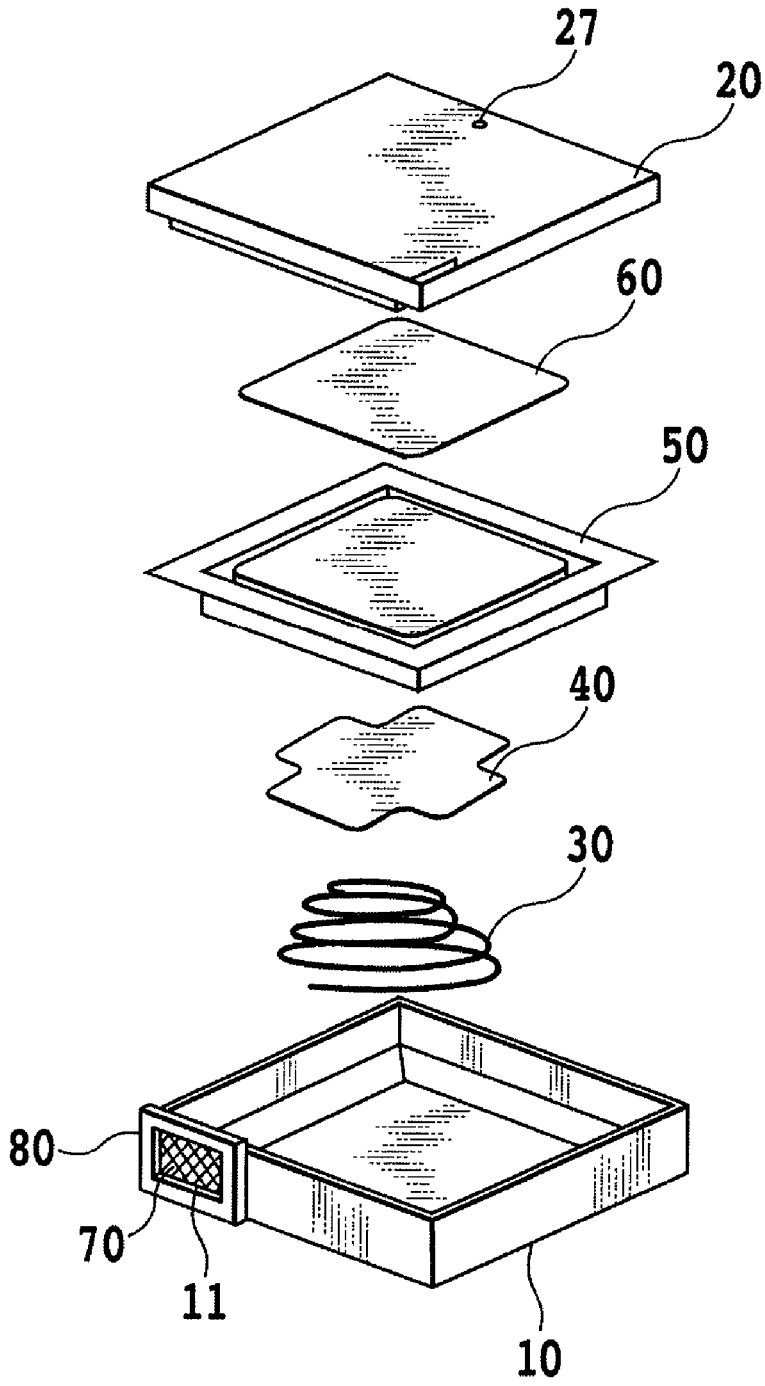
FIG. 2 is an exploded perspective view of the ink tank of FIG. 1.

FIG. 1 to FIG. 11 are drawings to explain the first embodiment of this invention. FIG. 1 is an outline perspective view of an ink tank in the first embodiment, and FIG. 2 is an exploded perspective view of the ink tank.

The ink tank of this embodiment, as shown in an outline perspective view of FIG. 1, comprises a case 10 and a cover member 20. An ink accommodation space is formed in the ink tank as a liquid accommodation space (liquid accommodation chamber), as described later. At its bottom the case 10 has an ink supply port 11 from which to supply ink from an ink accommodation space to a print head not shown.

As shown in FIG. 2, the ink tank has the case 10, a spring member 30, a plate member 40, a flexible film 50, a shock absorbing sheet 60, the cover member 20, a meniscus forming member 70 and a holding plate 80. The case 10 may, for example, be formed of a resin material such as polypropylene. Held at its circumferential part by the holding plate 80, the meniscus forming member 70 is attached to the ink supply port 11. The meniscus forming member 70 is a capillary tube member formed of a fiber material such as polypropylene or may be a combination of the capillary tube member and a filter member. The filter member has a penetration size of 15-30 μmm and is formed of such material as stainless steel and polypropylene. The meniscus forming member 70 is communicated to an ink accommodation space, described later, in the case 10 through an ink path (not shown). The meniscus forming member 70 forms a meniscus of ink to prevent possible ingress of air bubbles from outside to the ink accommodation space.

The case 10 forms the ink accommodation space therein by fusing the flexible film 50 to its open circumferential part. FIG. 2 shows a state in which the flexible film 50 is not yet fused to the open circumferential part of the case 10. The flexible film 50 may be formed of, for example, a polypropylene thin film (10-100 μmm thick). The spring member 30 urges the flexible film 50 outwardly through the plate member 40 to generate a negative pressure in the ink accommodation space. The spring member 30 may be formed of, for example, a stainless steel material. The open circumferential portion of the case 10 is mounted with the cover member 20 that protects the outwardly convex film 50. The cover member 20 is formed with an open air communication path 27, through which the interior of the case 10 outside the ink accommodation space is kept at an atmospheric pressure.

Figure 3A:
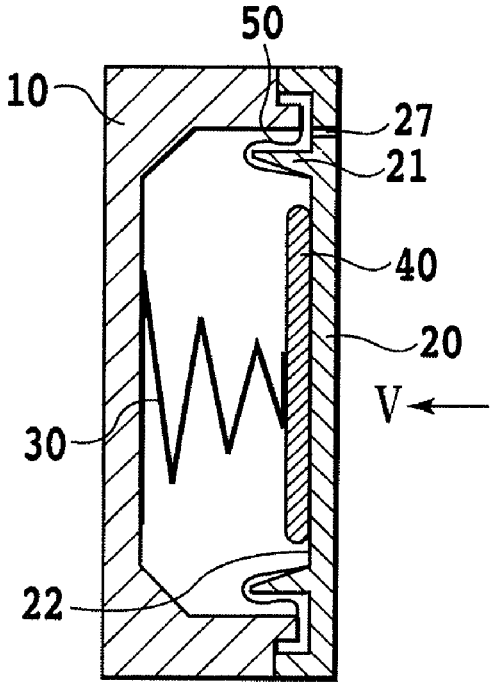
FIG. 3A is a cross-sectional view of the ink tank taken along the line III-III of FIG. 1 when it is not filled with ink.
Figure 3B:
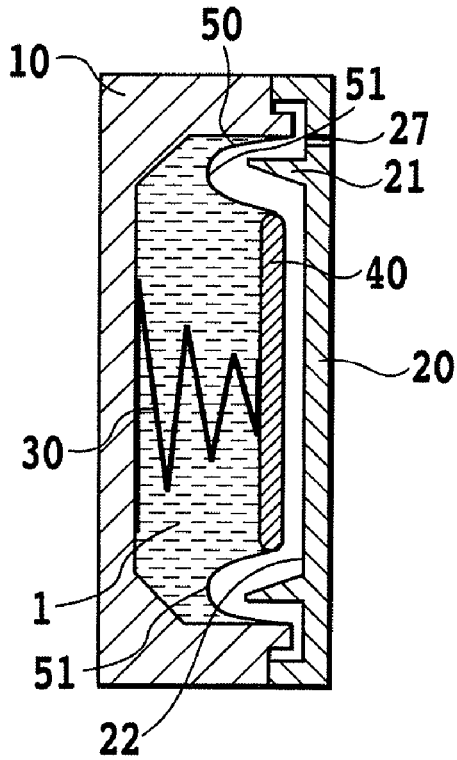
FIG. 3B is a cross-sectional view of the ink tank taken along the line III-III of FIG. 1 when it is filled with ink.

FIG. 3A and FIG. 3B are cross-sectional views of the ink tank of FIG. 1 taken along the line III-III, FIG. 3A showing a state of the ink tank immediately after its assembly with the ink tank not yet filled with ink, FIG. 3B showing the ink tank in use, with the ink accommodation space formed by the case 10 and the film 50 filled with ink 1. With the ink tank in use as shown in FIG. 3B, the plate member 40 is urged by the force of the spring member 30 to engage the film 50. The film 50 is biased in a direction that expands the ink accommodation space creating a negative pressure in the ink accommodation space. As the ink in the ink accommodation space is consumed, the plate member 40 and the flexible film 50 move to the left in FIG. 3B against the force of the spring member 30. While the amount of ink in the ink accommodation space changes, the negative pressure in the ink accommodation space remains almost constant.

Before the ink is filled, the film 50 is kept in a shape of FIG. 3A. After the ink is loaded as shown in FIG. 3B, the film 50, except the portion in contact with the plate member 40, deflects by the negative pressure in the ink accommodation space to form recessed portions 51.

Figure 4A:
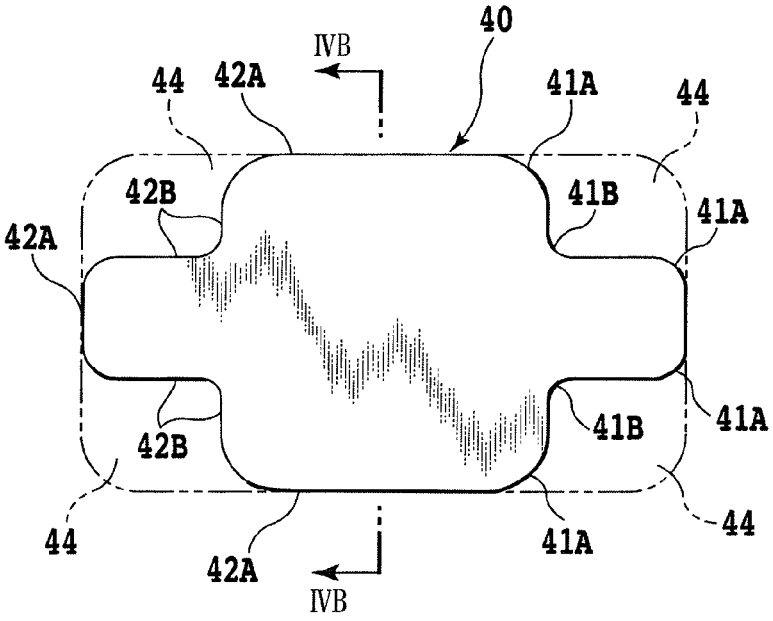
FIG. 4A is a front view of a plate member in the ink tank of FIG. 2.
Figure 4B:
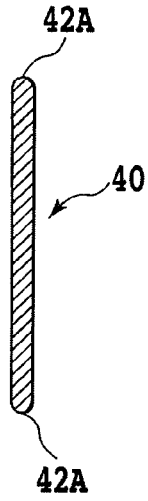
FIG. 4B is a cross-sectional view taken along the line IVB-IVB of FIG. 4A.

FIG. 4A is a front view of the plate member 40 and FIG. 4B is a cross-sectional view taken along the line IVB-IVB of FIG. 4A. The plate member 40 is formed of a resin material such as polypropylene and has a thickness of 1-2 mm over its entire range. The plate member 40 is a component in contact with the thin film 50, so its corner portions 41A, 41B are curved as shown in FIG. 4A. The corner portions 41A are outwardly curved and the corner portions 41B are inwardly curved. Edge portions (side portions) 42A connecting the two adjacent corner portions 41A and edge portions (side portions) 42B connecting the corner portions 41A and 41B are also rounded in cross section as shown in FIG. 4B. Having these corner portions curved and edge portions rounded can minimize damages to the film 50 that may be caused by the fall or vibrations of the ink tank. As described above, the plate member 40 of this example is formed in a planar shape with corner portions 41A, 41B and edge portions 42A, 42B.

Considering the shape and stiffness of the film 50, the plate member 40 of this embodiment is shaped almost like a cross. That is, an almost rectangular shape of a two-dot chain line is shown in FIG. 4A as an original shape of the plate member, and the final plate member 40 is obtained by cutting off four corners of the rectangular shape. Shown at 44 in FIG. 4A are those portions cut off from the four corners of the rectangular plate member. Before proceeding to explain the reason for adopting the shape of cross, the film 50 will be explained.

Figure 5:
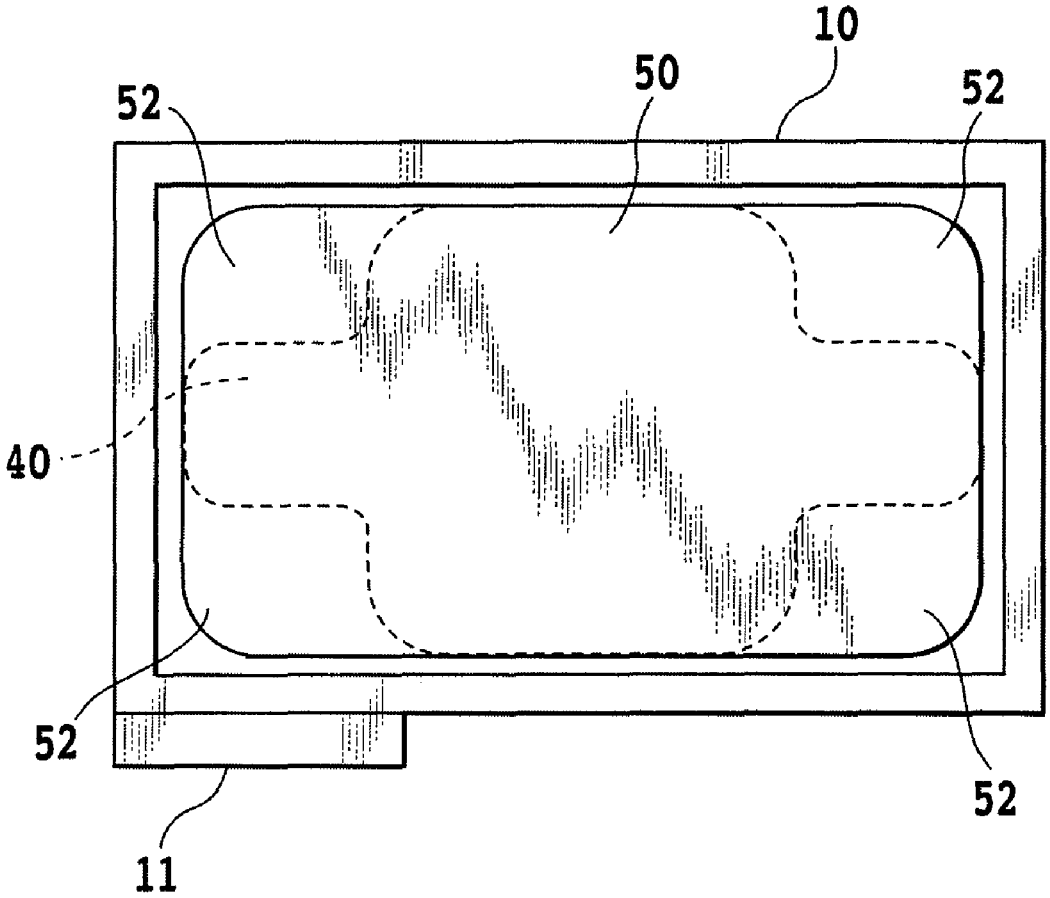
FIG. 5 is a front view of an essential part of the ink tank of FIG. 2, showing a positional relation between the plate member and a case.

As the ink in the ink tank is consumed, the film 50 moves toward the case 10 along with the plate member 40 until finally it sticks to the inner surface of the case 10, conforming to the inner contour of the latter, to eliminate the ink accommodation space to enable the ink to be used up completely. For this purpose, the film 50 is formed so that, when stretched, it has almost the same shape as the inner shape of the case 10. The film 50 in this embodiment is almost rectangular, like the inner shape of the case 10. FIG. 5 is a side view of the ink tank as seen from the direction of arrow V of FIG. 3A, with the cover member 20 removed. As shown in the figure, the film 50 in the side view is almost rectangular. Corner portions 52 at four corners of the film 50 are very likely to get twisted. Further, when the film 50 is pressed by a flat sheet of resin material and formed into a protruding shape, the corner portions 52 will become thin and have the lowest stiffness and strength.

Figure 6A:
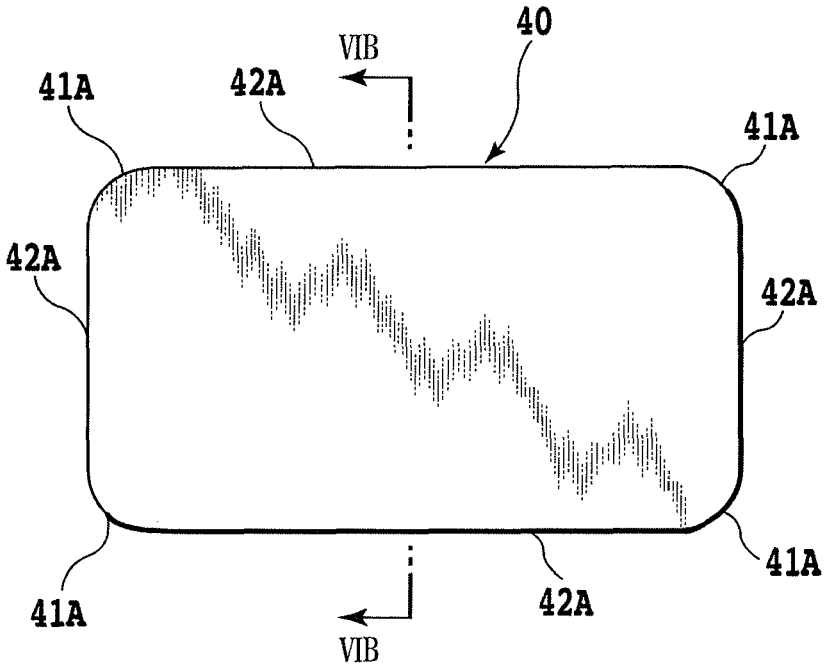
FIG. 6A is a front view showing another example of the plate member.
Figure 6B:
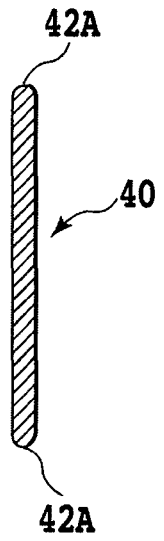
FIG. 6B is a cross-sectional view taken along the line VIB-VIB of FIG. 6A.

The reason that the plate member 40 is formed into the shape of cross is to prevent collisions between the plate member 40 and the cover member 20 from occurring at corner portions 52 of the film 50 in the event of fall or vibrations. For this reason, the plate member 40 is so shaped as to avoid contact with the corner portions 52 of the film 50. As described above, the cross shape of the plate member 40 in this embodiment is adopted as a preventive measure against possible damages to the film 50 that are likely to be caused because of the low stiffness of the corner portions 52. However, if the four corner portions 52 have sufficient stiffness, the plate member 40 may be formed into a roughly rectangular shape as shown in FIG. 6A and FIG. 6B.

Figure 7A:
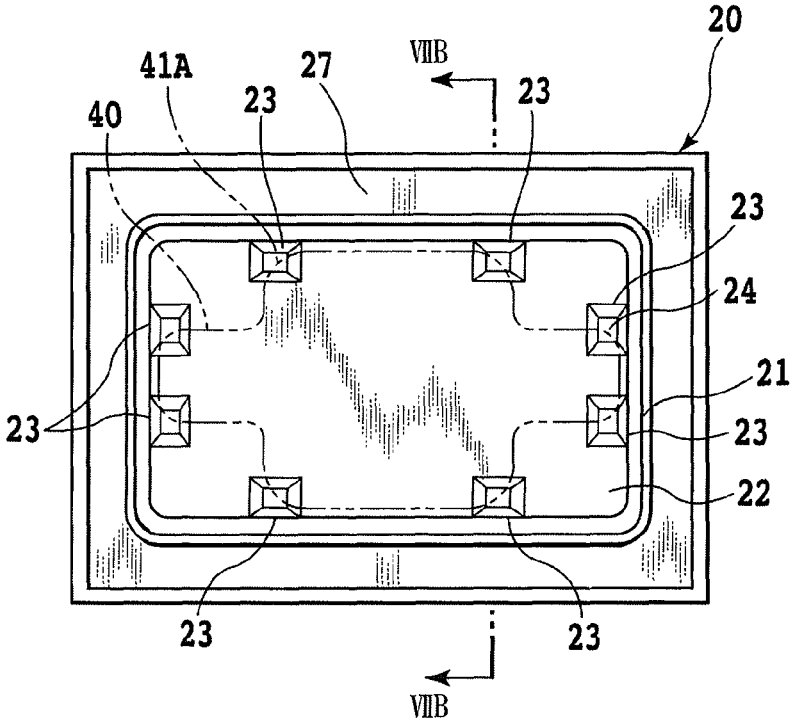
FIG. 7A is a front view of an essential part of the ink tank of FIG. 2, showing a positional relation between the plate member and a cover member.
Figure 7B:
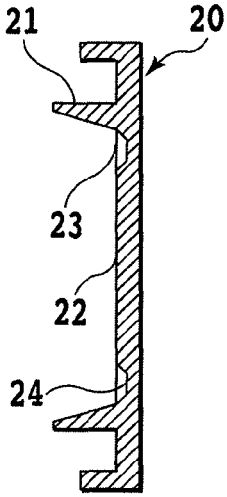
FIG. 7B is a cross-sectional view taken along the line VIIB-VIIB of FIG. 7A.

Next, referring to FIG. 7A and FIG. 7B, the cover member 20 will be explained. FIG. 7A is a front view of the cover member 20 and FIG. 7B is a cross-sectional view of the same taken along the line VIIB-VIIB of FIG. 7A.

The cover member 20 has almost the same external shape as the open circumference of the case 10 and is mounted to the case 10 to close the opening of the case and thereby form a space including the ink accommodation space (liquid accommodation chamber). The cover member 20 has a rib 21 formed on its inner surface 22 (on the liquid accommodation chamber side) that protrudes toward the case 10. The rib 21 is situated outside the plate member 40 to enclose the entire circumference. The rib 21 is intended to stabilize the negative pressure in the ink accommodation space. When subjected to external forces in the event of fall or vibrations of the ink tank, the plate member 40 can be restricted in its movement by the rib 21 to within a specified magnitude. Without the rib 21, the plate member 40 may be displaced by over the specified amount. If the plate member 40 should move by more than the specified amount, it tilts preventing the force of the spring member 30 from being transmitted directly to the plate member 40, with the result that the negative pressure within the ink accommodation space may be reduced. The rib 21 works as a stopper to limit the movement of the plate member 40 to within a specified amount.

In the inner surface 22 of the cover member 20 there are recessed portions 23, an area lower than other areas. Two-dot chain line in FIG. 7A represents the plate member 40. The recessed portions 23 are situated at positions corresponding to the corner portions 41A (see FIG. 4A) and their size is so set that they face the corner portions 41A of the plate member 40 even if the plate member 40 moves within the allowable range inside the rib 21. That is, the size of the recessed portions 23 is set such that, regardless of the displaced positions of the plate member 40, the recessed portions 23 always cover or include the corner portions 41A of the plate member 40 as shown in the front view of FIG. 7A. The recessed portions 23 in combination with the shock absorbing sheet 60 form shock absorbing portions 90 for the plate member 40.

Next, by referring to FIG. 8A and FIG. 8B, the shock absorbing sheet 60 that forms the shock absorbing portions 90 will be explained. The shock absorbing sheet 60 is formed of an elastic material which, in this embodiment, is a very inexpensive flexible sheet of polypropylene. Its thickness can be set according to a desired shock absorbing effect described later and, in the case of the ink tank of this embodiment, is set at around 0.01-1 mm.

Figures 8A, 8B:
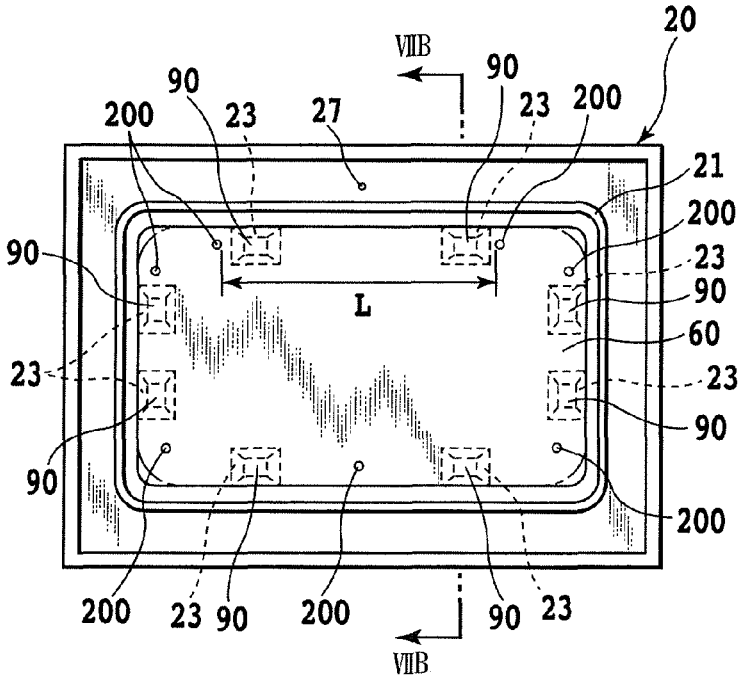
FIG. 8A is a front view of an essential part of the ink tank of FIG. 2, showing a positional relation between the cover member and a shock absorbing sheet.
FIG. 8B is a cross-sectional view taken along the line VIIIB-VIIIB of FIG. 8A.

FIG. 8A and FIG. 8B show the shock absorbing sheet 60, that forms the shock absorbing portions 90, and the cover member 20 bonded together. Dotted lines in FIG. 8A represent the recessed portions 23. The shock absorbing sheet 60 is so shaped as to cover almost the entire area of the inner surface 22 of the cover member 20 on the inner side of the rib 21, and is bonded to other areas on the inner surface 22 than the recessed portions 23. In this embodiment, the shock absorbing sheet 60 is bonded by heat fusing. The bonding parts of the shock absorbing sheet 60 are located at positions on both sides of one or more recessed portions 23. In this example, seven bonding regions 200 are set as the bonding locations. By setting the bonding regions 200 on both sides of the recessed portions 23, the shock absorbing sheet 60 can be put in its place without causing any cockling in those portions covering the openings of the recessed portions 23. Therefore, when the shock absorbing sheet 60 just above the recessed portions 23 is subjected to a load, it elastically deforms toward the interior of the recessed portions 23 to absorb the impact force.

The bonding regions 200 keep the shock absorbing sheet 60 in its restricted position so that, when the shock absorbing sheet 60 deforms toward the inside of the recessed portions 23, it is prevented from reaching a bottom 24 of the recessed portions 23. More specifically, as to a minimum distance L between paired bonding regions 200 on both sides of one or more recessed portions 23, the relation between a distance LA on the cover member 20 and a length LB on the shock absorbing sheet 60 is set to LA>LB. The distance LA is a minimum distance along the inner surface of the cover member 20 between the paired bonding regions 200 and the length LB is a minimum length of the shock absorbing sheet 60 present between the paired bonding regions 200. These distance LA and length LB are equal to or more than the minimum distance L. The relation of LA>LB prevents the shock absorbing sheet 60, when deformed toward the interior of the recessed portions 23 or the inner surface of the cover member 20, from reaching the bottom 24 of the recessed portions 23. The bonding regions refer to bonding portions provided on the inner surface of the cover member on the liquid accommodation chamber side.

The distance L in FIG. 8A represents the minimum distance connecting two bonding regions 200 situated at an upper left and an upper right of the inner surface 22 of the cover member 20. In this minimum distance range there are two recessed portions 23. That is, these bonding regions 200 are located on the outer sides of the two recessed portions 23. Another pair of bonding regions 200 situated at a lower center and at a lower right in FIG. 8A are on both sides of one recessed portion 23. Similarly, another pair of bonding regions 200 situated at a lower center and at a lower left in the figure are on both sides of one recessed portion 23. In either case, the relation of LA>LB restrains the deformation of the shock absorbing sheet 60 so that the shock absorbing sheet 60 does not reach the bottom 24 of the recessed portions 23. The paired bonding regions 200 need only be set such that at least one recessed portion 23 comes between them.

The relation of LA>LB is set considering the elastic deformation of the shock absorbing sheet 60. That is, the difference between the distance LA and the length LB is set larger as the shock absorbing sheet 60 becomes more likely to deflect elastically because of its material property and stiffness in order to prevent the shock absorbing sheet 60 from reaching the bottom 24 of the recessed portions 23 when it elastically deforms toward the interior of the recessed portions 23. As long as the shock absorbing sheet 60 can perform its shock absorbing function by its elastic deformation, the length LB may be set equal to the minimum distance L between the paired bonding regions 200.

The bonding regions 200 need only be joint portions capable of keeping the shock absorbing sheet 60 in its restricted position. The shock absorbing sheet 60 may be kept in its place by other methods than fusing, such as using the cover member to hold it. The only requirement is that the bonding regions 200 be used in pair between which one or more recessed portions 23 come and that the relation between the minimum distance LA and the minimum length LB be set to LA>LB, the minimum distance LA representing a distance between the paired bonding regions along the inner surface of the cover member 20, the minimum length LB representing a length of the shock absorbing sheet 60 present between the paired bonding regions 200.

Where the shock absorbing sheet 60 elongates most is a part facing the center of each recessed portion 23. The amount of deflection of the shock absorbing sheet 60 decreases as the point of interest goes from the part facing the center of the recessed portion to a part facing the periphery of the recessed portion. In this example, the recessed portion fulfills its function by a mortar shape thereof. If the recessed portions 23 are formed like a mortar, an inner volume of the recessed portion can be set small, minimizing a reduction in strength of the cover member 20 and therefore its deformation when applied an external force. However, if the cover member 20 has a sufficient strength, the recessed portions 23 may be formed otherwise. When combined with the shock absorbing sheet 60, the recessed portions 23 of the cover member 20 form the shock absorbing portions 90.

Figure 9A:
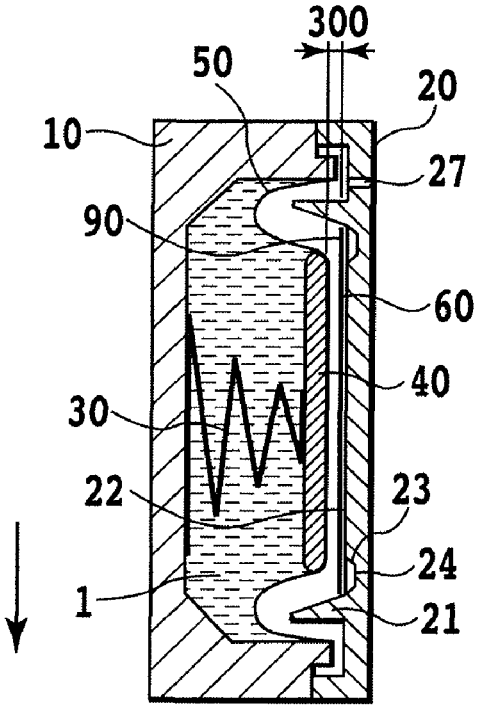
FIG. 9A is a cross-sectional view of the ink tank of FIG. 2 during transport.
Figure 9B:
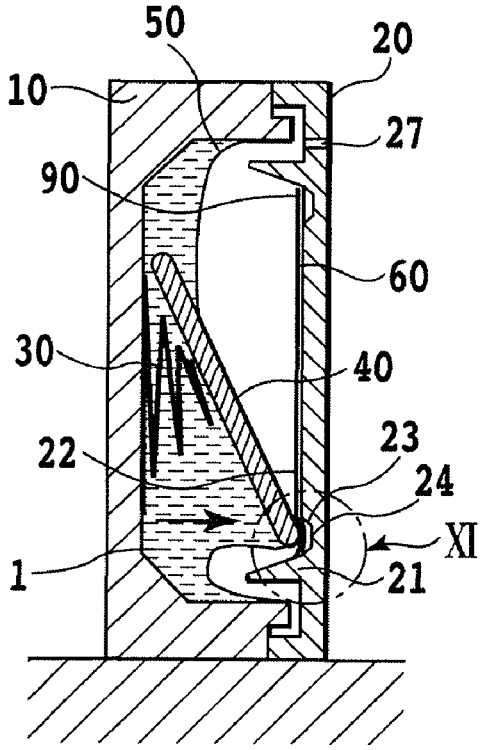
FIG. 9B is a cross-sectional view of the ink tank of FIG. 2 at time of its fall.

FIG. 9A and FIG. 9B explain a relation between the plate member 40 and the shock absorbing portions 90 when the ink tank falls. FIG. 9A is a cross-sectional view of the ink tank before it falls during shipping. FIG. 9B is a cross-sectional view when the falling ink tank hits the ground. These cross-sectional views are taken along the line III-III of FIG. 1.

In the state of FIG. 9A during shipping, the ink tank is fully loaded with ink and the ink is not consumed at all. In this state, the plate member 40 is situated on the inner side of the rib 21 of the cover member 20, with a clearance 300 between the plate member 40 and the inner surface 22 of the cover member 20. The clearance 300 between the plate member 40 and the inner surface 22 is set such that, if the cover member 20 is deformed by an external force, it does not engage the plate member 40. Should the cover member 20 when applied an external force push the plate member 40, the ink accommodation space may be compressed, changing the negative pressure therein. To prevent such a negative pressure change a predetermined clearance 300 is provided between the plate member 40 and the cover member 20.

When the ink tank falls in a direction (direction of arrow of FIG. 9A) perpendicular to the direction of compression and expansion of the spring member 30 and hits the ground, the ink 1 in the ink accommodation space moves further in the direction of gravity by inertia, as shown in FIG. 9B. Since the film 50 accommodating the ink is soft and easily deformable, the ink 1 rushes toward the ground-impacting side of the ink tank (lower side in FIG. 9B) and at the same time moves toward the film 50 side. The plate member 40 similarly moves toward the ground-impacting side by inertia. It then is tilted, as shown in FIG. 9B, by the ink 1 moving toward the film 50 side, with the impact side of the plate member 40 shifting to the cover member 20 side. Since this series of behaviors instantaneously occurs the moment the ink tank falls, the plate member 40 impacts the cover member 20 very strongly with high falling energy.

Figure 10A:
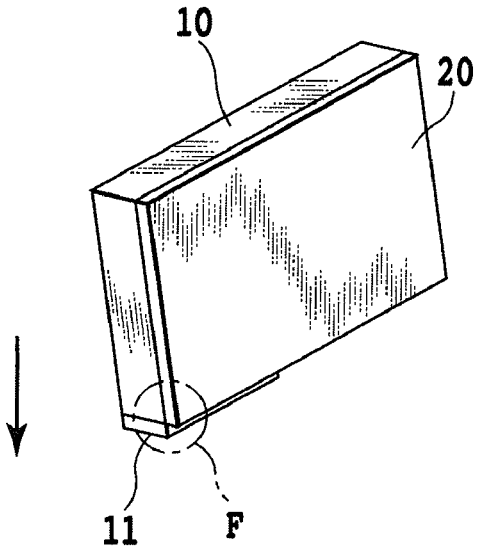
FIG. 10A is a perspective view showing an attitude of the ink tank of FIG. 2 as it falls.
Figure 10B:
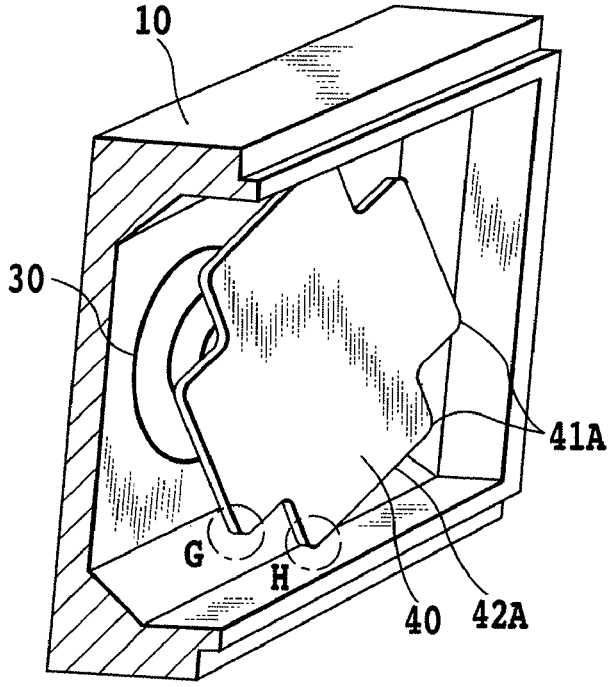
FIG. 10B is an outline perspective view of an essential part of the ink tank of FIG. 2 showing a state of the ink tank at the moment of impact.

Next, by referring to FIG. 10A and FIG. 10B more detailed explanations will be given as to the falling attitude of the ink tank and the behavior of the plate member. FIG. 10A is a perspective view showing an attitude of the ink tank during the fall. FIG. 10B is a perspective view of the ink tank with the plate member 40 and the film 50 removed and the case 10 partly cut away, showing how the plate member 40 behaves the moment the ink tank falls and hits the ground.

The ink tank, though it may fall with its flat outer surface landing on the ground, mostly falls in a slightly tilted attitude with a corner portion first landing on the ground, as shown in FIG. 10A. That is, the ink tank of almost rectangular parallelepiped mostly falls with one of eight corner portions first hitting the ground. When, for example, the corner portion F of FIG. 10A impacts the ground, the plate member 40 tilts with its corners G, H near the corner portion F of the ink tank protruding downward, as shown in FIG. 10B. As described above, when the ink tank falls, the corner portions 41A of the plate member 40 first strike the inner surface 22 of the cover member 20 in most cases.

Figure 11:
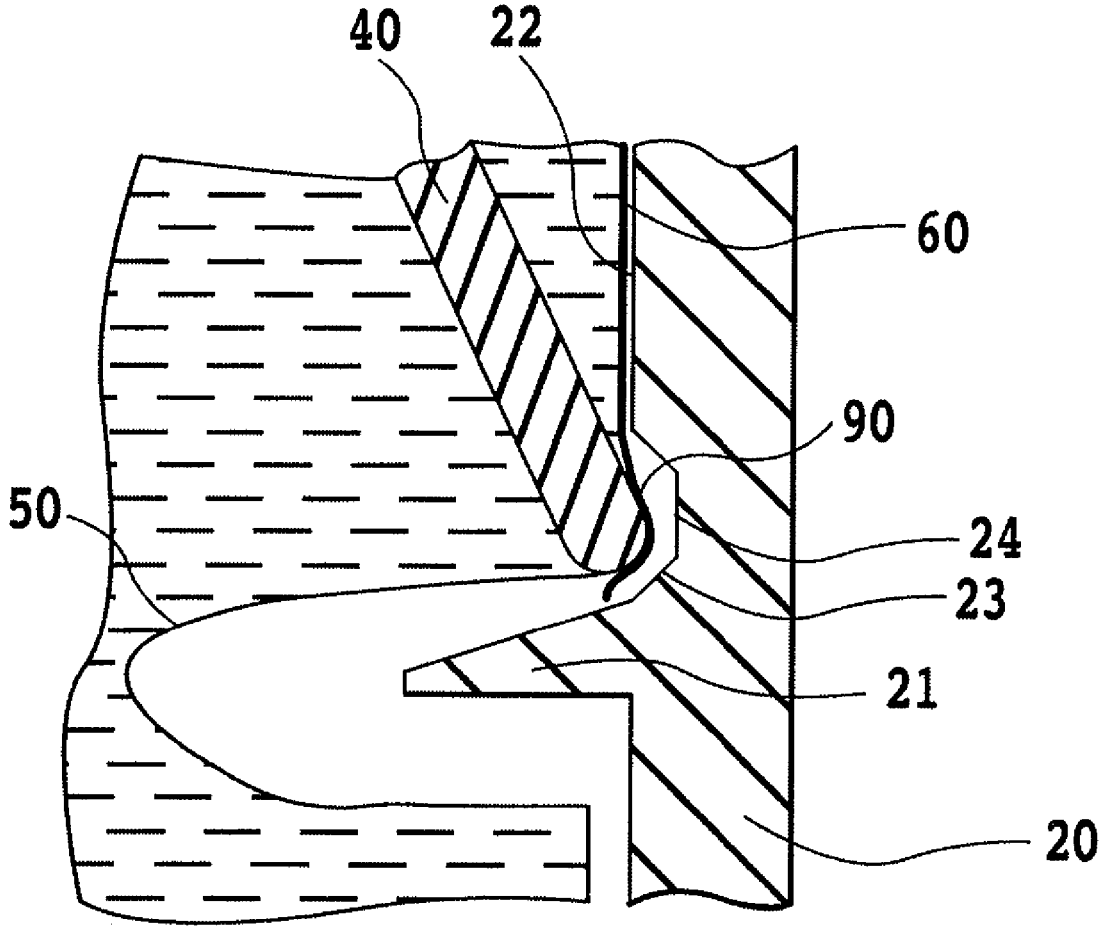
FIG. 11 is an enlarged view of a circled part XI of FIG. 9B.

FIG. 11 is an enlarged cross-sectional view of an essential parts showing the plate member 40 hitting the shock absorbing portion 90 formed in the inner surface 22 of the cover member 20.

The plate member 40 is kept in its position by the rib 21 of the cover member 20. As described earlier, wherever within the restricted range the plate member 40 is situated, the corner portions 41A face the recessed portions 23 of the cover member 20 through the shock absorbing sheet 60. That is, the corner portions 41A are always at positions facing the shock absorbing portions 90. Therefore, the corner portions 41A of the plate member 40 come into engagement with the shock absorbing portions 90 without fail but do not contact other regions of the inner surface 22 of the cover member 20. When the corner portions 41A of the plate member 40 hit the shock absorbing portions 90, the shock absorbing portions 90 of the shock absorbing sheet 60 and their surrounding portions first deflect, starting to absorb an impact energy of the plate member 40 produced by the fall of the ink tank. Then the shock absorbing sheet 60 deflects further until it absorbs all impact energy of the plate member 40, stopping the movement of the plate member 40 toward the cover member 20 side. The bonding regions 200 restrain the movement of the shock absorbing sheet 60 to keep it in its restricted position. Thus, the shock absorbing sheet 60, the film 50 and the plate member 40 do not reach the bottom 24 of the recessed portions 23 even if the shock absorbing sheet 60 deflects most.

Therefore, the film 50 does not directly contact the rigid cover member 20 and is prevented from being pinched between the plate member 40 and the cover member 20 and thereby protected against damages.

Second Embodiment

Figure 12:
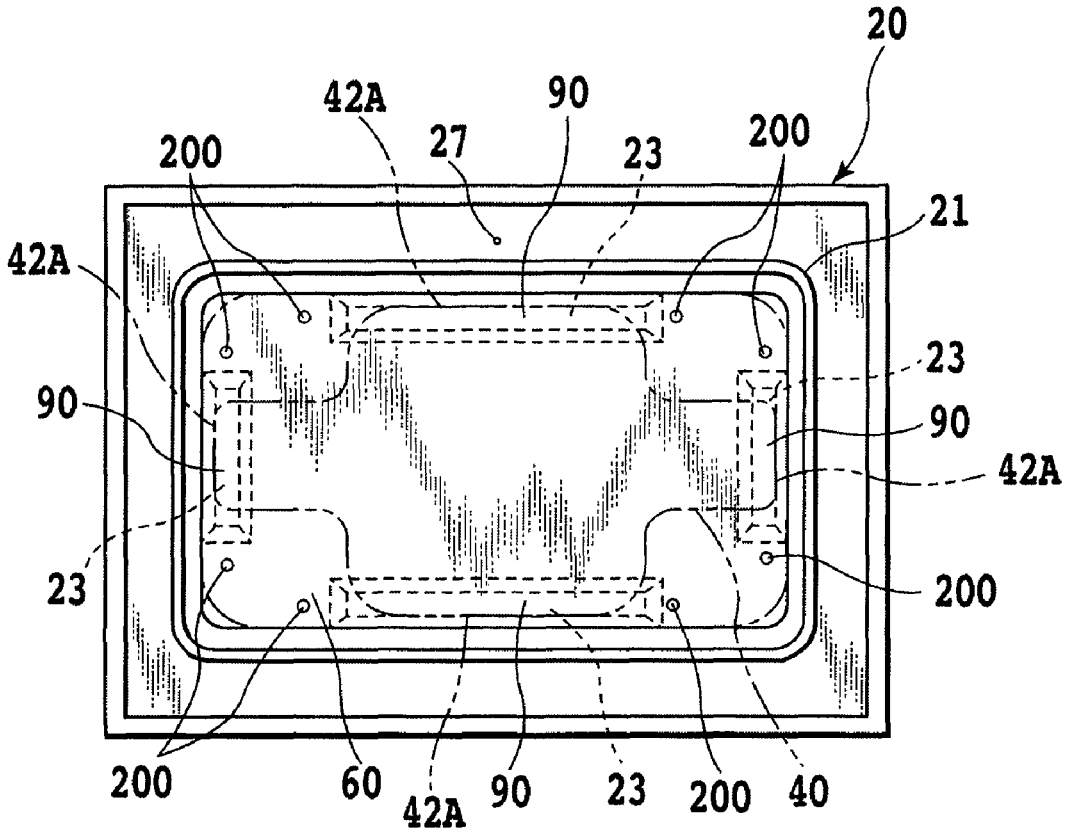
FIG. 12 is a front view of essential parts of the ink tank in a second embodiment of this invention, showing a positional relation among a cover member, a shock absorbing sheet and a plate member.

Next, the construction of an ink tank according to a second embodiment of this invention will be explained by referring to FIG. 12. FIG. 12 is a front view of a cover member 20 and a shock absorbing sheet 60, combined together to form shock absorbing portions 90.

The ink tank of this embodiment is so constructed as to be able to prevent damages to the film 50 if the ink tank falls with its flat outer surface landing on the ground. That is, the ink tank can prevent damages to the film 50 even if the film 50 has low stiffness and is liable to damage and if not only the corner portions 41A but also the edge portions 42A of the plate member 40 strike the inner surface 22 of the cover member 20.

The recessed portions 23 of the cover member 20 in this embodiment are wider than those of the first embodiment. That is, the size of the recessed portions 23 is so set that, if the plate member 40 moves in an allowable range inside the rib 21, the recessed portions 23 always oppose the corner portions 41A and the edge portions 42A of the plate member 40. More specifically, in the front view of FIG. 12, the size of the recessed portions 23 is set such that, regardless of the displaced positions of the plate member 40, the recessed portions 23 always cover or include the corner portions 41A and the edge portions 42A. The recessed portions 23 in combination with the shock absorbing sheet 60 form shock absorbing portions 90 for the plate member 40, as in the preceding embodiment.

In this construction, if the edge portions 42A of the plate member 40 strike the inner surface 22 of the cover member 20, the impact can be absorbed by the shock absorbing portions 90 without fail. The film 50 can be protected against possible damages.

Figure 13A:
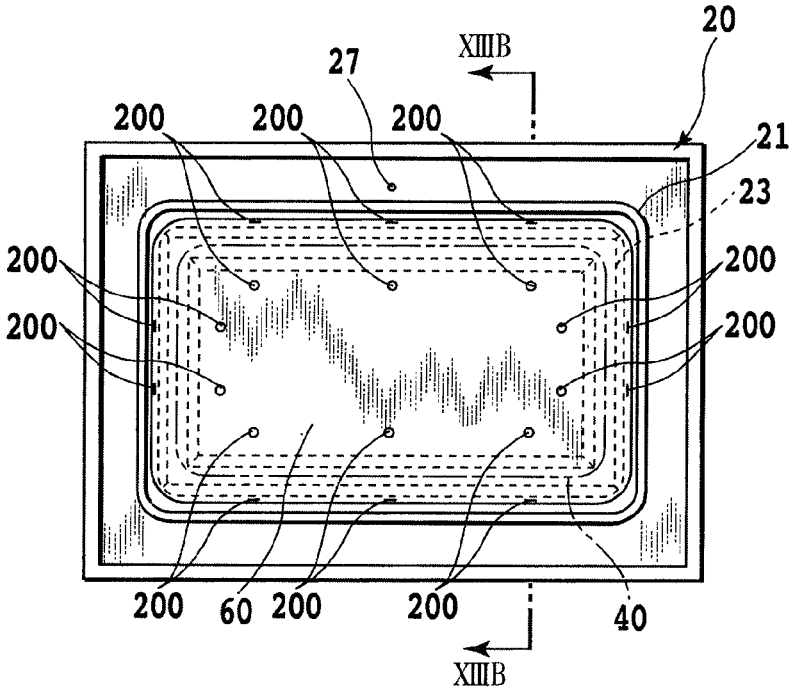
FIG. 13A is a front view of an essential part of the ink tank, showing another example of the plate member and a positional relation between the plate member and the corresponding cover member and shock absorbing sheet.
Figure 13B:
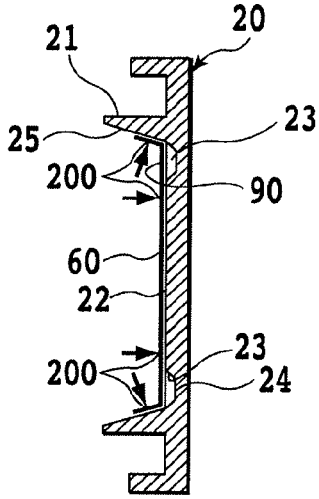
FIG. 13B is a cross-sectional view taken along the line XIIIB-XIIIB of FIG. 13A.

FIG. 13A and FIG. 13B show a construction having an almost rectangular plate member 40 like the one shown in FIG. 6A. FIG. 13A shows a recessed portion 23 of the cover member 20 and a shock absorbing sheet 60, combined together to form shock absorbing portions 90.

The recessed portion 23 in this embodiment is formed like a ring directly inside the rib 21 in a shape similar over the entire circumference to the rib 21. Therefore, the bonding regions 200 cannot be set on both sides of the recessed portion 23 in a circumferential direction of the plate member 40, as they were in FIG. 8A and FIG. 12. In this embodiment, therefore, the shock absorbing sheet 60 is made slightly larger in the similar shape than that of FIG. 12 and the bonding regions 200 are set on the inner and outer sides of the annular recessed portion 23. Thus the paired bonding regions can be placed on the inner and outer sides of the recessed portion 23, with the inner bonding region 200 of the pair situated on the inner surface 22 of the cover member 20 and with the outer bonding region 200 situated on the surface 25 of the rib 21. The arrows in FIG. 13B represent directions in which the shock absorbing sheet 60 is attached to the bonding regions 200. In this example, two pairs of bonding regions 200 are set along a shorter side of the rectangular recessed portion 23 and three pairs along a longer side. As described above, a plurality of pairs of bonding regions 200 can be set along one side of the rectangular recessed portion 23.

By keeping the shock absorbing sheet 60 in its restricted position by the bonding regions 200, the shock absorbing sheet 60 can be prevented from engaging the bottom 24 of the recessed portion 23 when it deflects, thereby absorbing the impact of the plate member 40. With this construction, the intended effect of this invention can also be produced to prevent damages to the film 50.

Third Embodiment

Figure 14A:
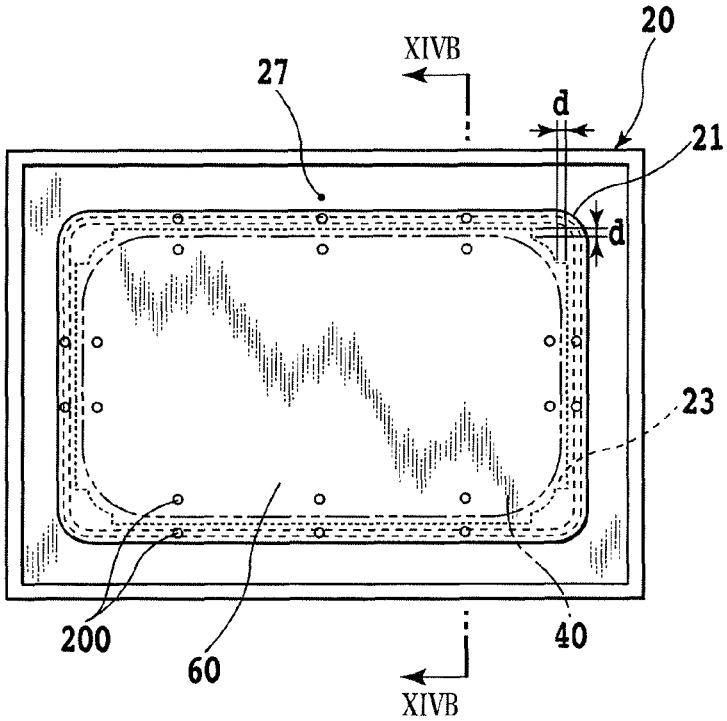
FIG. 14A is a front view of essential parts of the ink tank in a third embodiment of this invention, showing a positional relation among a cover member, a shock absorbing sheet and a plate member.
Figure 14B:
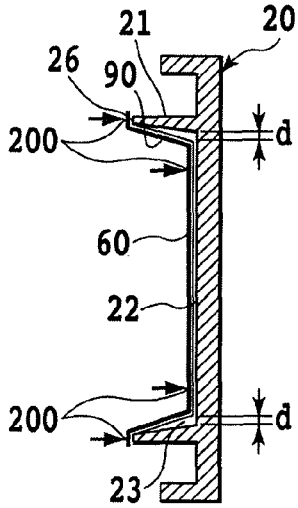
FIG. 14B is a cross-sectional view taken along the line XIVB-XIVB of FIG. 14A.
Figure 15:
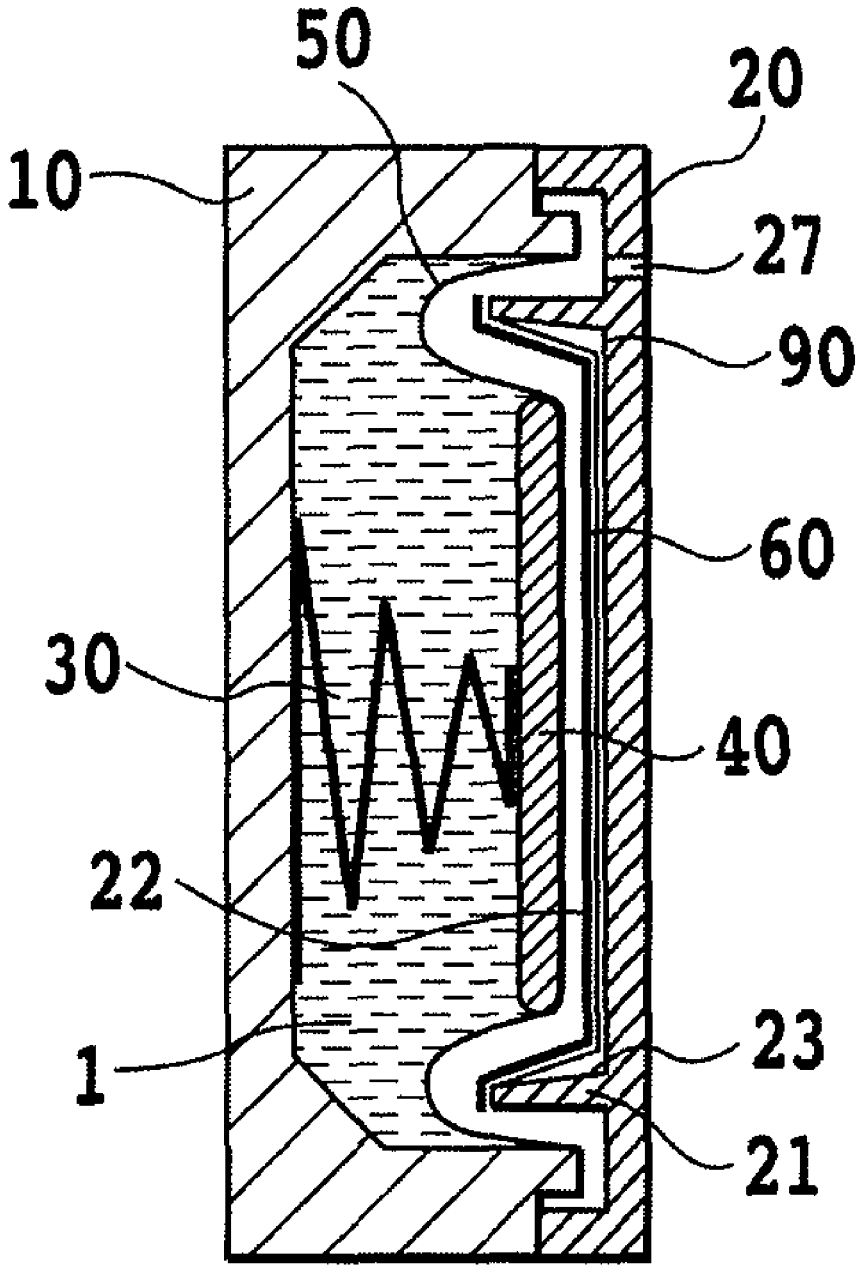
FIG. 15 is a cross-sectional view of the ink tank of FIG. 14A.

Next, the construction of an ink tank according to a third embodiment of this invention will be explained by referring to FIG. 14A, FIG. 14B, FIG. 15 and FIG. 24A-24C. FIG. 14A is a front view showing a recessed portion 23 of the cover member 20 and a shock absorbing sheet 60, combined together to form a shock absorbing portion 90. FIG. 14B is a cross-sectional view taken along the line XIVB-XIVB of FIG. 14A. FIG. 15 is a cross-sectional view of the ink tank of this embodiment taken along the line III-III of FIG. 1. FIG.

Figure 24B:
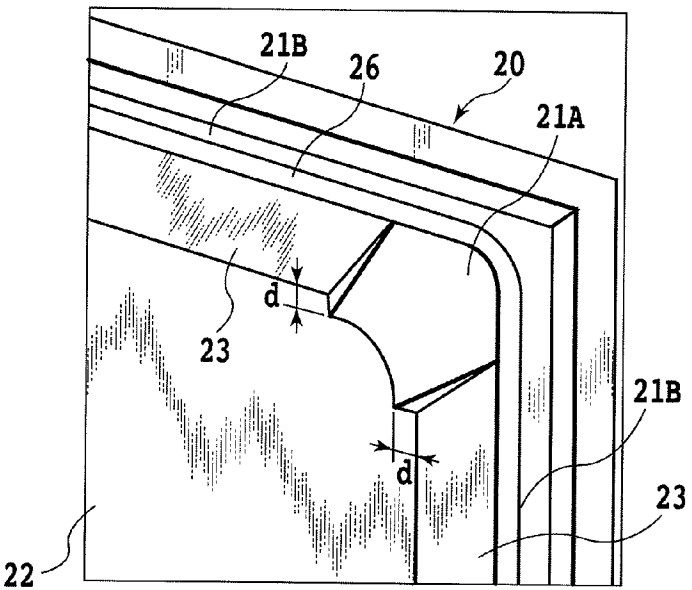
FIG. 24B is an enlarged view of a part XXIVB of FIG. 24A.
Figure 24A:
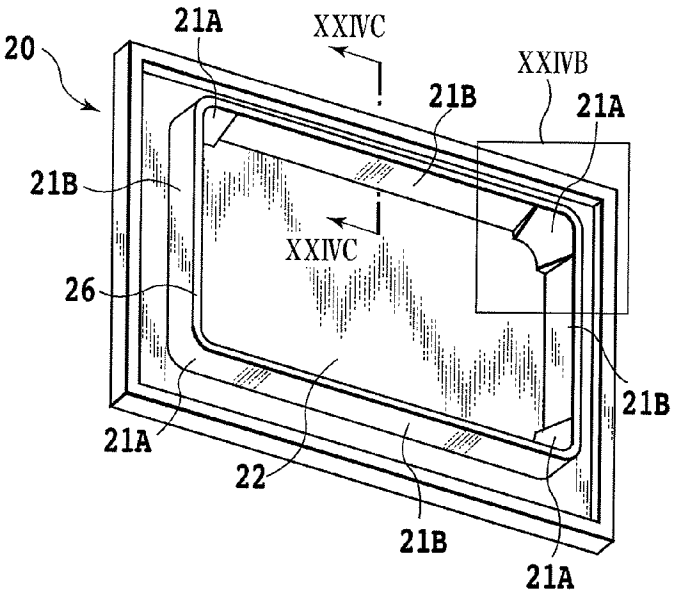
FIG. 24A is a perspective view of the cover member of FIG. 14A.
Figure 24C:
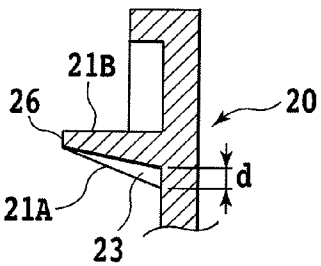
FIG. 24C is a cross-sectional view taken along the line XXIVC-XXIVC of FIG. 24A.

24A is a perspective view of the cover member of FIG. 14A. FIG. 24B is an enlarged view of a portion XXIVB of FIG. 24A. FIG. 24C is a cross-sectional view taken along the line XXIVC-XXIVC of FIG. 24A.

As described above, when the ink tank falls and hits the ground, the plate member 40 moves in the gravity direction and at the same time tilts to move its impacting side toward the cover member 20. At this time, the plate member 40 may first hit the rib 21 of the cover member 20, rather than striking the inner surface 22 of the cover member 20. In that case, the film 50 may get pinched between the rigid plate member 40 and the rib 21 and damaged. This embodiment protects the film 50 against damage also when the plate member 40 hits the rib 21.

The plate member 40 of this embodiment is formed almost rectangular, like the one shown in FIG. 6A. The plate member 40 may also be shaped like a cross as in the preceding embodiment. The rib 21 of the cover member 20 of this embodiment differs in shape from the rib 21 of the preceding embodiment shown in FIG. 13A and FIG. 13B. That is, the rib 21 of this embodiment has its four corner portions 21A formed relatively thick, like the rib 21 of FIG. 13A and FIG. 13B, but other portions 21B formed relatively thin with its inner circumferential surface setback by a distance d. The four side portions 21B of the rib 21, which is formed like a rectangular frame when viewed from above, have their inner circumferential surfaces (inner wall surfaces) recessed by a distance d from the four corner portions 21A, so that their base is thinner than that of the corner portions 21A. These recessed portions correspond to the recessed portions 23 of the preceding embodiment. That is, the recessed portions 23 are formed on the inner surfaces of the side portions 21B set back by a distance d from the inner surfaces of the corner portions 21A. In this example, an inclination of the inner surfaces of the side portions 21B differs from an inclination of the inner surfaces of the corner portions 21A, forming the recessed portions 23 over the entire inner surfaces of the side portions 21B, as shown in FIG. 24C.

The shape of the shock absorbing sheet 60 matches that of the inner surface 22 of the cover member 20 and is so sized as to cover an entire top portion 26 of the rib 21. The bonding regions 200 are set at the inner surface 22 and the rib 21 of the cover member 20 so that the recessed portions 23 come between these bonding regions 200. In this example, the bonding regions 200 on the rib 21 side are placed at the top portion 26. As in the preceding embodiment, the recessed portions 23 and the shock absorbing sheet 60 combine to form shock absorbing portions 90. More precisely, the shock absorbing portions 90 to absorb the impact of the plate member 40 can be formed by putting the shock absorbing sheet 60 at the opening of the recessed portions 23 formed on the inner surface of the side portions 21B when the shock absorbing sheet 60 is bonded to the top portion 26.

With this construction, the shock absorbing portions 90 can be provided at the rib 21 of the cover member 20, as shown in FIG. 15. As a result, if the plate member 40 hits the rib 21 of the cover member 20, the shock absorbing portions 90 can protect the film 50 against damages.

(Method of Forming Flexible Film 50)

Here let us explain in detail the flexible film 50 (hereinafter referred to convex type sheet) in the liquid container of this invention. The convex type sheet is common to all embodiments.

The convex type sheet 50 of this invention has its central part restrained by a flat plate member 40 and its peripheral part deformable. The convex type sheet 50 is formed by a forming method described later into a convex shape having a folded portion, almost trapezoidal in cross section. The convex type sheet 50 is formed to protrude toward a biasing direction of the spring member 30. The plate member 40 and the convex type sheet 50 are secured together at their central part to prevent them from shifting from each other when subjected to vibrations or impacts caused by fall during shipment of the ink tank. In this example, the plate member 40 and the convex type sheet 50 are formed of a resin material and fused together. Therefore, the side of the convex type sheet 50 that contacts the plate member 40 is preferably made of the same material as the plate member 40 which, in this example, is polypropylene. With the cover member 20 attached to the open peripheral portion of the case 10, the convex type sheet 50 is protected. The cover member 20 is formed with an open air communication path 27, through which the outside of the ink accommodation space in the case 10 is set equal to the atmospheric pressure.

Referring to FIG. 16A to FIG. 18, the method of forming the convex type sheet 50 and a thickness distribution of the formed sheet will be explained.

Figure 16A:
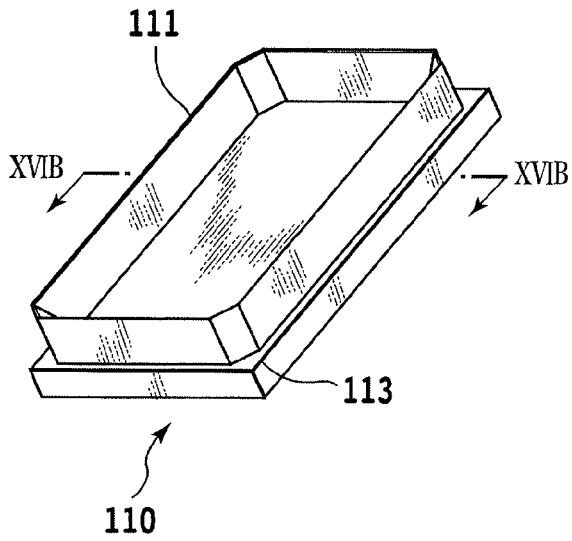
FIG. 16A is a perspective view of a die by which to form a convex type sheet of this invention.
Figure 16B:
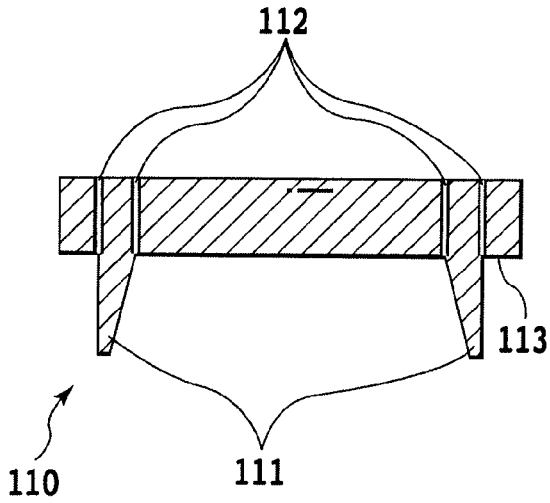
FIG. 16B is a cross-sectional view taken along the line XVIB-XVIB of FIG. 16A.
Figure 17:
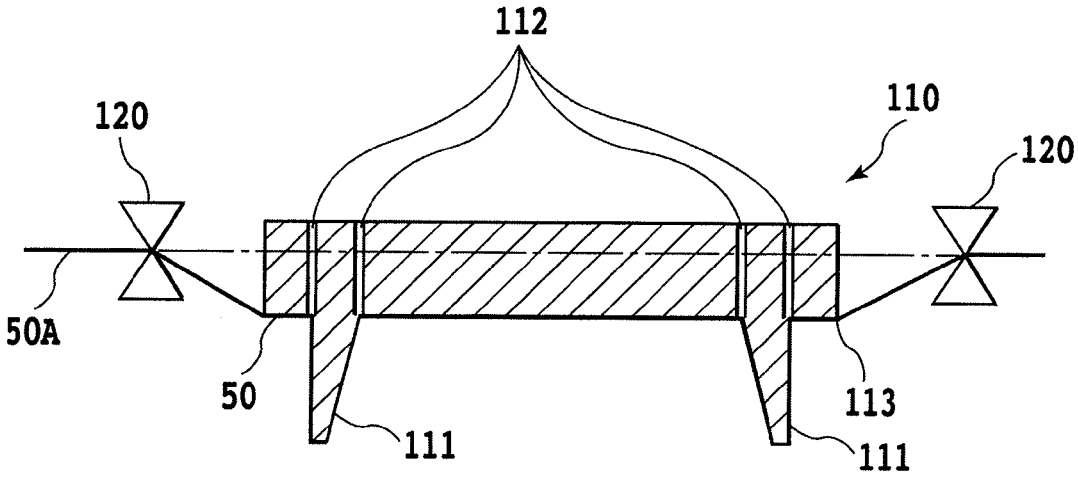
FIG. 17 is a cross-sectional view of the die, showing a method of forming the convex type sheet in this invention.
Figure 18:
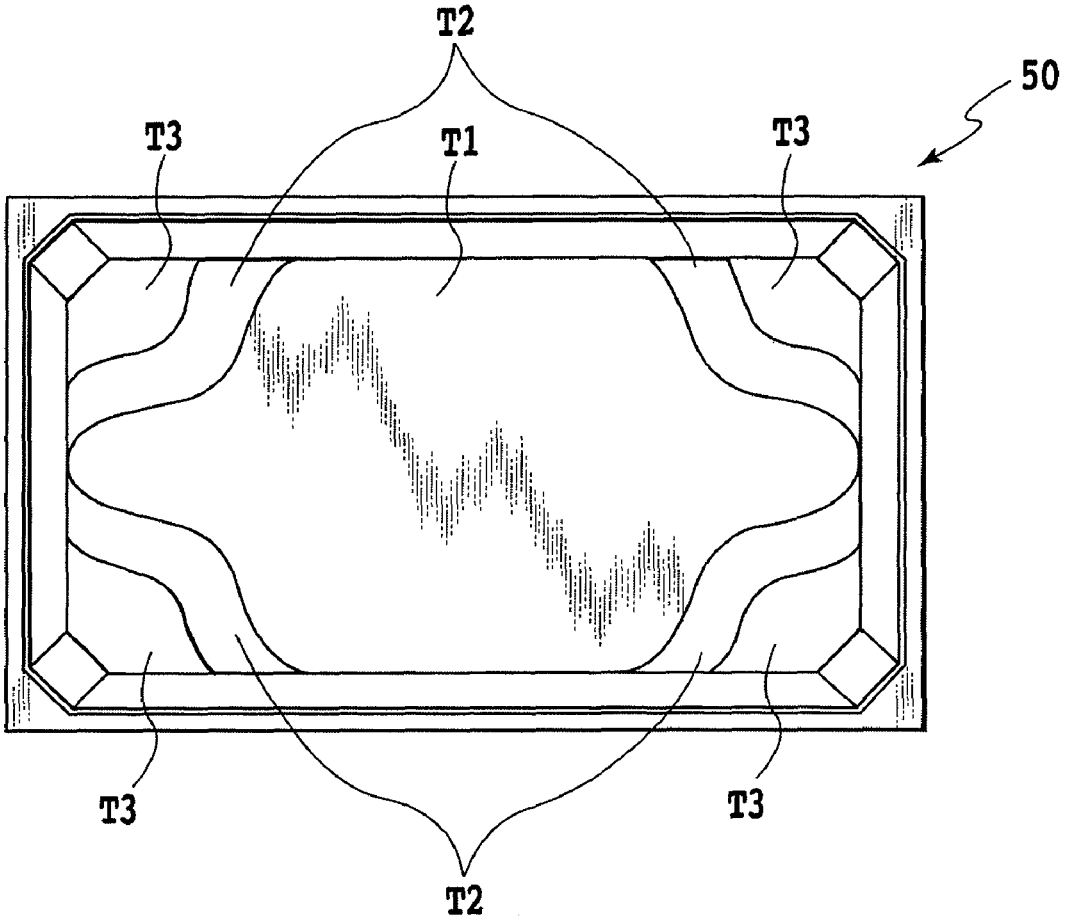
FIG. 18 is a schematic diagram showing a distribution of thickness of the convex type sheet in this invention.

FIG. 16A is a perspective view of a forming die 110 to form the convex type sheet 50. FIG. 16B is a cross-sectional view of the die 110 taken along the line XVIB-XVIB of FIG. 16A. FIG. 17 illustrates the convex type sheet 50 being formed. FIG. 18 shows a thickness distribution of the formed convex type sheet 50.

The die 110 is provided with a raised portion 111, as shown in FIG. 16A. On the inner circumferential side and the outer circumferential side of the base of the raised portion 111 there are formed a plurality of ports 112 over the entire circumference through which to evacuate air. In FIG. 17, denoted 50A is a planar sheet material from which to form the convex type sheet 50. In forming the convex type sheet 50, the first step is to securely hold the circumference of the resin sheet material 50A by a fixing jig 120 to keep horizontally flat an area of the sheet material 50A to be formed into the convex type sheet 50, as shown by one-dot chain line in FIG. 17. Then, the die 110 is lowered until its outer edge 113 comes into contact with the sufficiently heated sheet material 50A. Then, air is drawn out through the ports 112 of the die 110 to bring the sheet material 50A into intimate contact with the forming surface of the die 110 to form the sheet material 50A into a convex shape.

FIG. 18 schematically shows a thickness distribution of the convex type sheet 50 formed by the above forming method and kept in contact with the plate member 40. The thickness distribution varies according to the thickness of the pre-forming sheet material 50A and to dimensions such as height of the raised portion 111 of the die 110. The convex type sheet 50 of this example is equal to or more than 51 μmm thick in a T1 area, 40-50 μmm thick in a T2 area, and less than 40 μmm thick in a T3 area.

Figure 19:
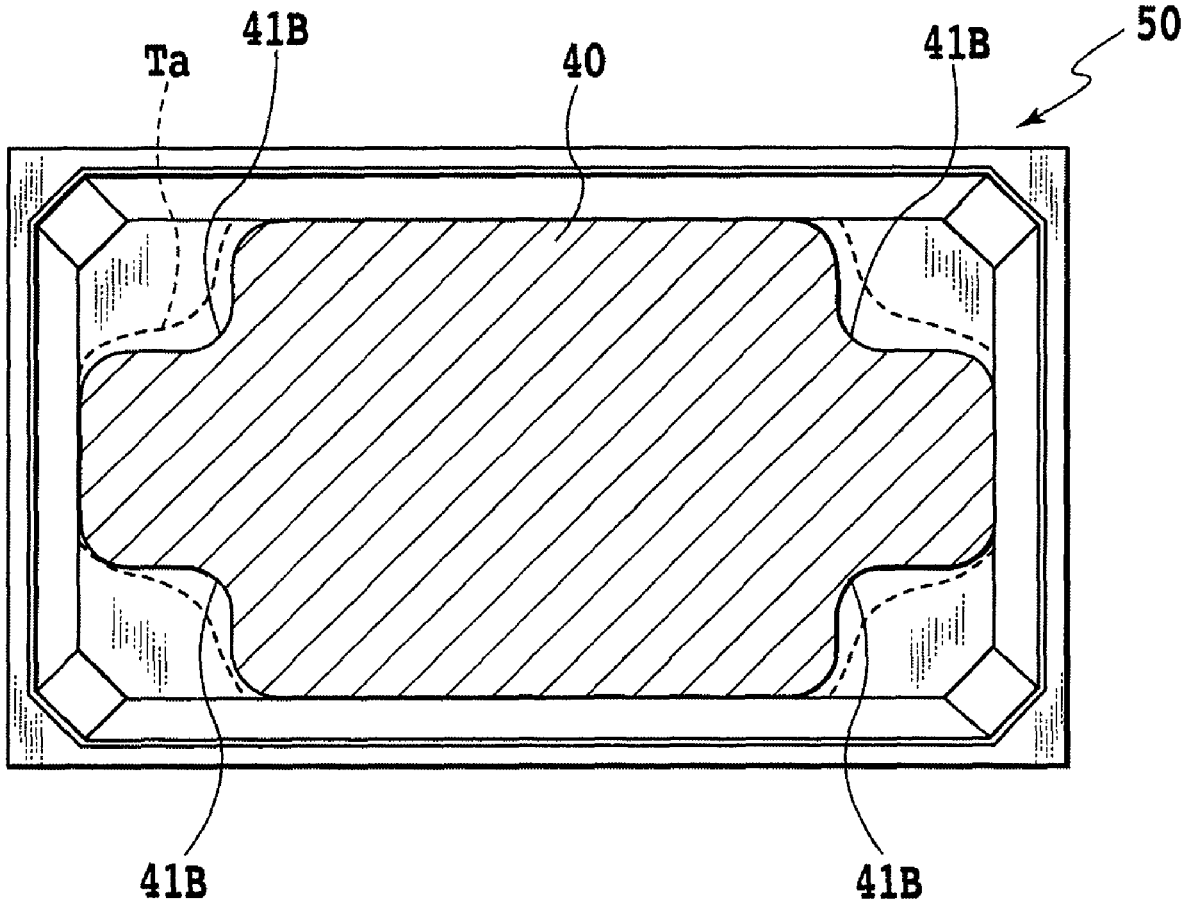
FIG. 19 is a front view showing a positional relation between the convex type sheet and the plate member in this invention.

FIG. 19 represents a positional relation between the convex type sheet 50 formed in this manner and the plate member 40. The inner surface of the convex type sheet 50, with which the plate member 40 is placed in contact, is rectangular in plan view. The plate member 40 is cross-shaped, like the one shown in FIG. 4A and FIG. 4B. That is, the plate member 40 is like a rectangular flat plate in plan view with the four corners cut off. The cut-off portions constitute the inwardly concave corner portions 41B. As described above, when the convex type sheet 50 get pinched between the plate member 40 and the cover member 20 as a result of the ink tank hitting the ground, the convex type sheet 50 may be damaged. A dashed line Ta in FIG. 19 represents a boundary line between a thickness region where the convex type sheet 50 may get damaged when the pinching occurs and a thickness region where there is no such possibility, i.e., a thickness threshold line between a region likely to be damaged and a region unlikely to be damaged. The inner side of the dashed line Ta represents a region where the convex type sheet 50 is not likely to be damaged when it is pinched between the plate member 40 and the cover member 20 as a result of fall of the ink tank. The outer side of the dashed line Ta represents a region where the sheet 50 is likely to be damaged. Since the thickness on the dashed line Ta, i.e., the thickness threshold for the likelihood of damage, changes according to the ink tank construction and weight, it is determined by actually performing free fall tests. In this example, the thickness threshold is found to be 40 μmm. So, the dashed line Ta comes between region T2 and region T3 in FIG. 18.

Figure 20A:
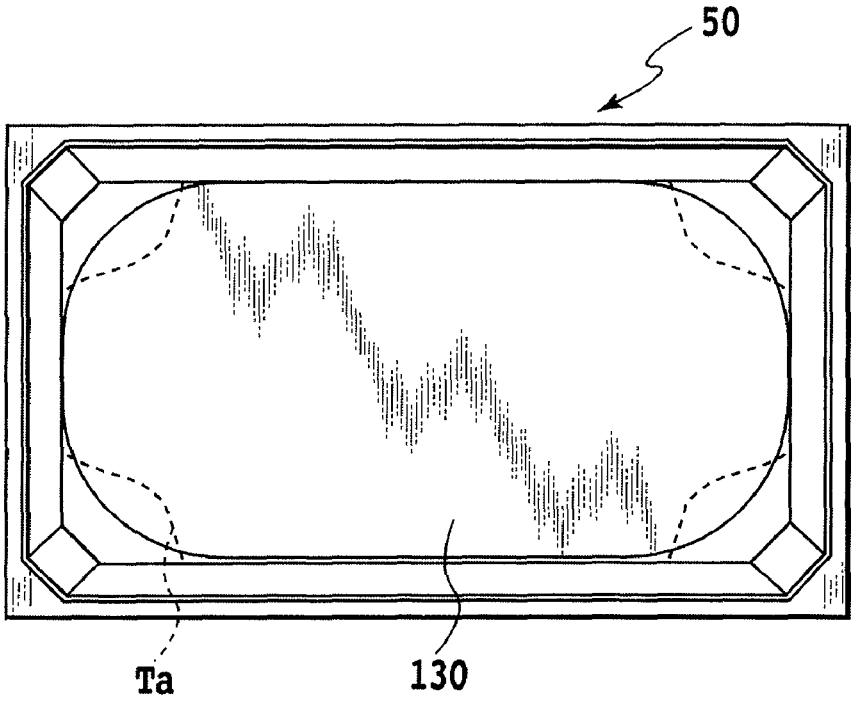
FIG. 20A is a front view showing a positional relation between a general plate member and the convex type sheet.
Figure 20B:
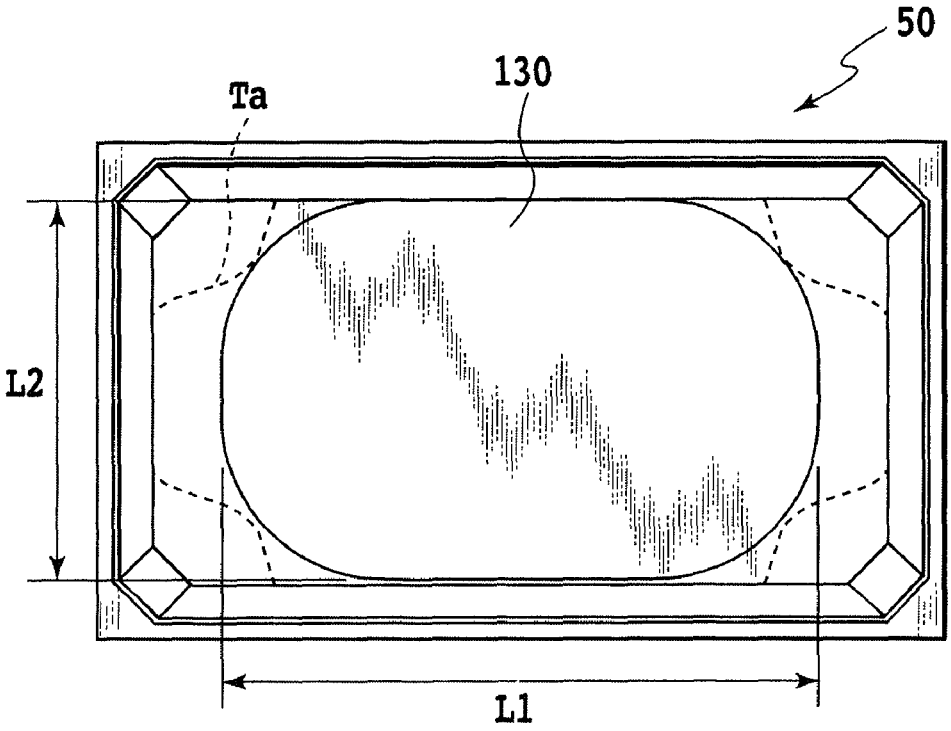
FIG. 20B is a front view showing a positional relation between another general plate member and the convex type sheet.

FIG. 20A and FIG. 20B show a positional relation between the convex type sheet 50 with the above thickness distribution and the rectangular plate member 130 with its corners rounded. The plate member 130 of FIG. 20A, even if rounded at its corners, partly extends into the outside of the dashed line Ta, i.e., into a region smaller in thickness than the threshold. Therefore, there is a possibility of the convex type sheet 50 being damaged as a result of fall of the ink tank. To keep the plate member 130 inside the dashed line Ta, the length L1 (or L2) of the plate member 130 needs to be reduced significantly as shown in FIG. 20B.

Figure 21:
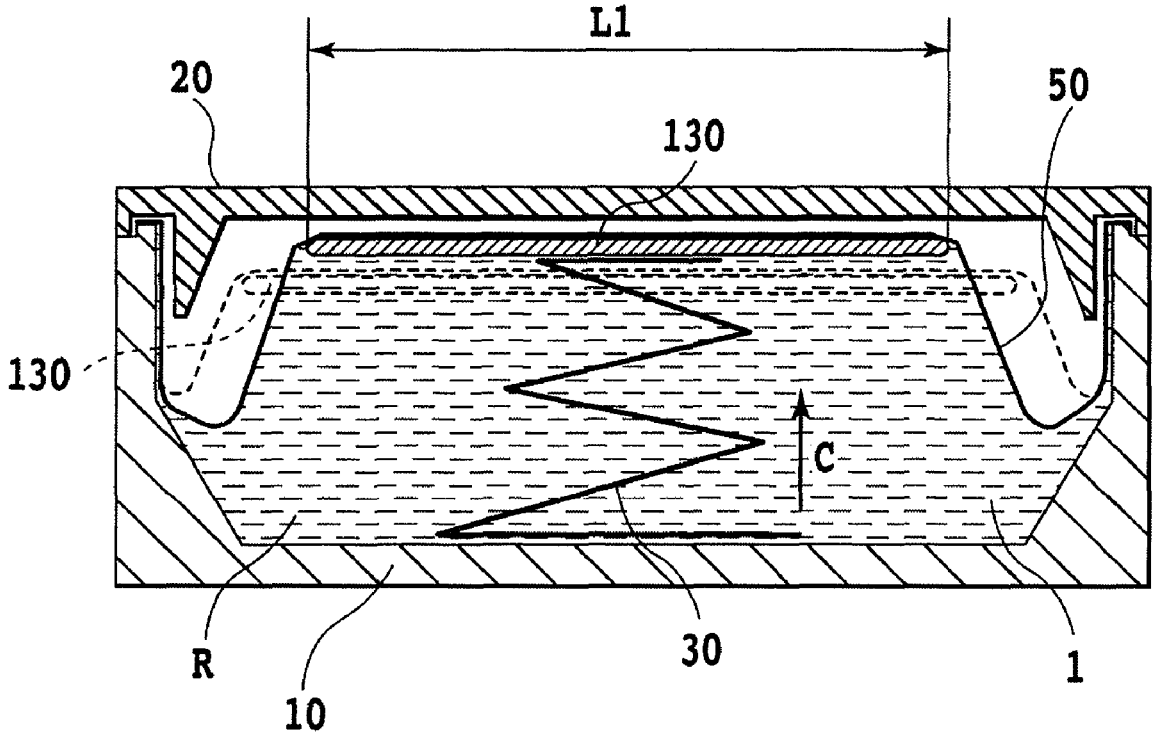
FIG. 21 is a cross-sectional view of an ink tank having the plate member of FIG. 20B.
Figure 22A:
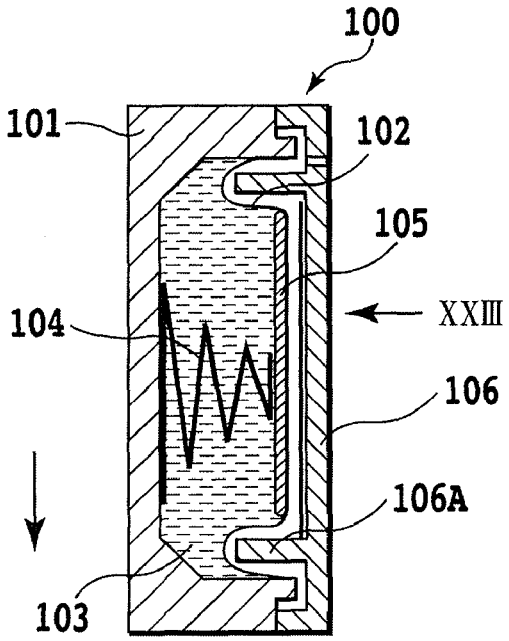
FIG. 22A is a cross-sectional view showing a state of a conventional ink tank before its fall.
Figure 22B:
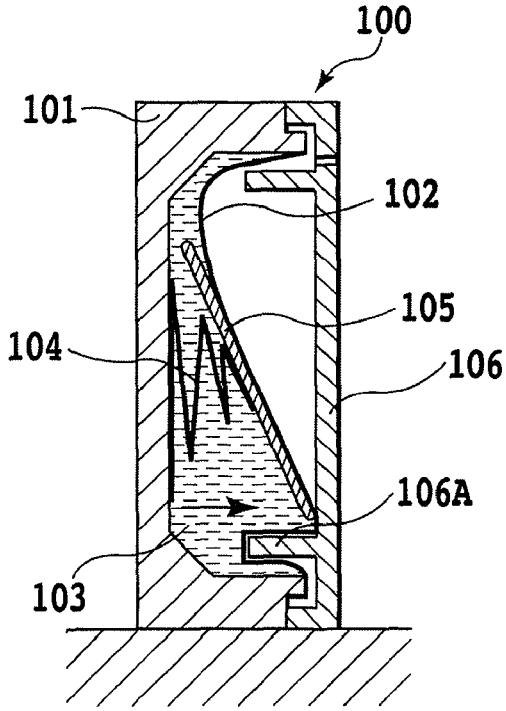
FIG. 22B is a cross-sectional view showing a state when the falling ink tank hits the ground.
Figure 23:
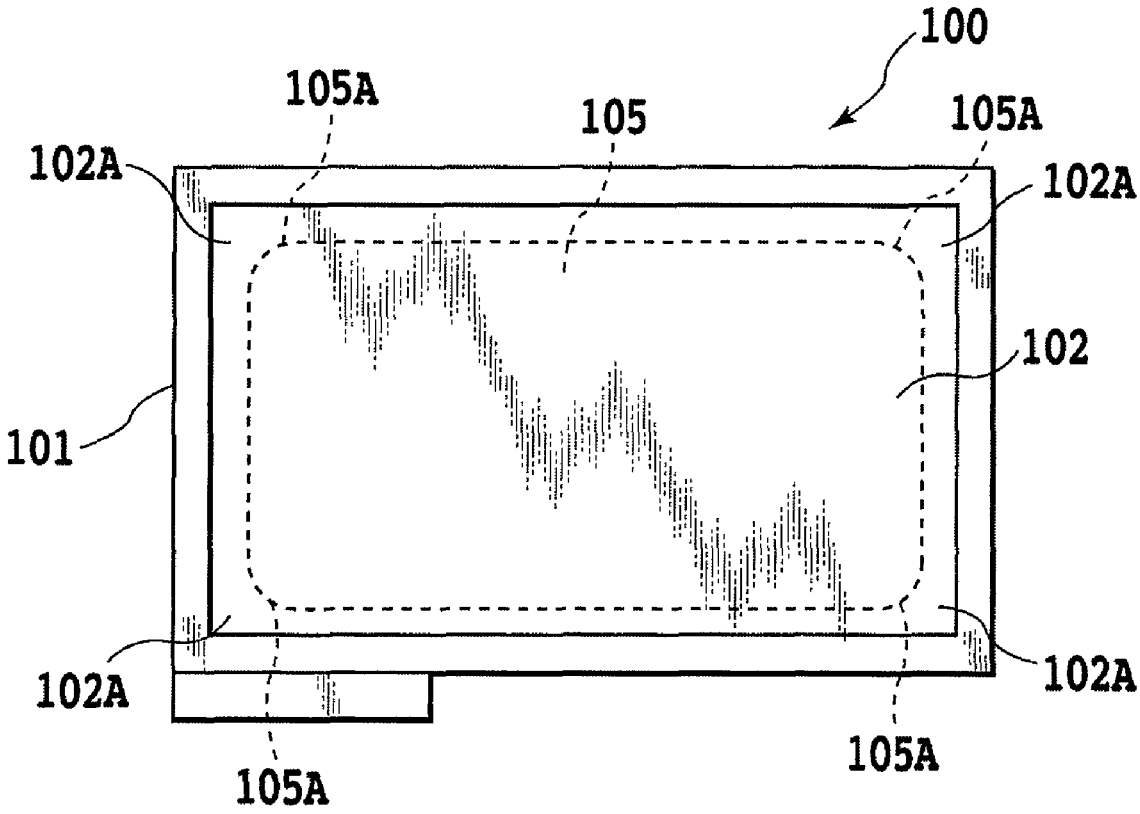
FIG. 23 is an essential-part front view showing a positional relation among a case, a film and a plate member of the ink tank of FIG. 22A.

FIG. 21 is a cross-sectional view used to explain drawbacks that will result when the length of the plate member 130 is shortened as shown in FIG. 20B. In FIG. 21 the plate member 130 shown in solid line represents the plate member of FIG. 20B and the plate member 130 shown in dashed line represents the plate member of FIG. 20A. When the length L1 is reduced significantly, like the plate member 130 shown in solid line of FIG. 21, the portions of the convex type sheet 50 that have lost the support of the plate member 130 are drawn into the ink accommodation space R by the negative pressure in the accommodation space. Therefore, the ink 1 will move toward the central part of the ink accommodation space R, pushing up the plate member 130 in the direction of arrow C. As a result, the spring member 30 that follows the plate member 130 also elongates in the direction of arrow C, giving rise to a possibility of the negative pressure in the ink accommodation space R decreasing. Further, the reduced length of the plate member 130 makes it hard for the ink accommodation space R to be contracted enough to use up ink 1. It is therefore difficult to fully consume the ink 1 to a degree that there is no ink remaining in the ink accommodation space R. Since a variety of drawbacks arise from the shortened length of the plate member 130 as described above, a substantial redesign of the ink tank is required.

The plate member 40 of this embodiment, on the other hand, has its corner portions cut off, as shown in FIG. 19, according to the thickness distribution of the convex type sheet 50 of FIG. 18 such that the plate member 40 lies inside the dashed line Ta. That is, without having to shorten its length, the plate member 40 can be situated within an area where the convex type sheet 50 is thicker than the thickness threshold represented by the dashed line Ta. By providing the cut-off portions in the plate member 40 as described above, the convex type sheet 50 can be protected against damage without causing any problem that would otherwise be experienced when the length of the plate member 40 is shortened.

As described above, in this embodiment the provision of the corner cut-off portions in the plate member enables the convex type sheet to be protected against damage without having to make significant design changes to the ink tank or to add special members such as protective sheet to prevent damages to the convex type sheet. The corner cut-off portions also provide an ink tank having a large ink accommodation capacity with high reliability by protecting the convex type sheet against damages that would otherwise be caused by impact as a result of fall of the ink tank. The corner cut-off portions also allow the convex type sheet to be formed as thin as the conventional sheet in portions that correspond to the corner cut-off portions of the plate member. The provision of the corner cut-off portions therefore can offer an ink tank with a good consume-ink-to-the-last-drop performance that is realized by contracting the ink accommodation space R enough to completely use up ink contained therein.

Other Embodiments

The case and the flexible film need only be able to form a liquid accommodation chamber to accommodate liquid such as ink. The supply port need only be able to draw the liquid out from the liquid accommodation chamber. These are not limited to the constructions shown in the preceding embodiments. The spring member need only be able to bias the flexible film to create a negative pressure in the ink accommodation space and its shape and installation position are not limited to those shown in the preceding embodiments. For example, the spring may be installed in the ink accommodation space as in the preceding embodiments or outside it.

The locations of the recessed portions provided in the cover member are not limited to only the inner surface of the cover member situated inside the rib, as in the first and second embodiment, or to only the inner wall surface of the rib as in the third embodiment. For example, the recessed portions may be provided to both surfaces. The only requirement is that the recessed portions be situated at locations toward which a part (corners and sides) of the plate member moves in the event of an impact of the plate member. The shape and the number of the recessed portions are not limited to those described in the preceding embodiments. The rib does not have to be formed annular but may be located at discrete positions enclosing the circumference of the plate member.

The rectangular shape and cross shape in plan view of the film and the shock absorbing sheet need only be roughly rectangular or cross-like. They may be rounded at corners or partly include straight or curved portions. The only requirement is that they be formed practically rectangular or cross-like. Further, when the liquid container of this invention is applied to the ink tank used in an ink jet printing apparatus, an ink jet cartridge may be formed by combining the ink tank and an ink jet print head. The ink jet print head is a print head capable of ejecting ink supplied from the ink tank, and an ink ejection energy generation elements may use an electrothermal converter (heater) or a piezoelectric element.

As the shock absorbing member situated at the opening of the recessed portion, a member other than the elastic shock absorbing sheet described above may be used. The only requirement is that the shock absorbing member be situated at the opening of the recessed portion and be able to elastically deform toward the interior of the recessed portion in the event of impact of the plate member to perform the shock absorbing action. It is also possible to almost hermetically seal the opening of the recessed portion by the shock absorbing member to use air trapped in the recessed portion as an air cushion.

This invention can also be applied widely as a liquid container to accommodate a variety of liquids other than ink.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-003496, filed Jan. 10, 2008, which is hereby incorporated by reference herein in its entirety.

What is claimed is:

1. A liquid container comprising:

a case and a flexible film to form a liquid accommodation chamber capable of accommodating a liquid;

a supply port to draw out the liquid from the liquid accommodating chamber;

a plate member situated on an inner surface of the film;

a spring member to bias the film through the plate member to create a negative pressure in the liquid accommodation chamber;

a cover member situated on an outer side of the film;

a recessed portion provided on an inner surface of the cover member opposing the plate member; and a shock absorbing member situated at an opening of the recessed portion and elastically deformable toward an interior of the recessed portion when the plate member is impacted.

2. The liquid container according to claim 1, wherein the shock absorbing member does not deform to an extent that reaches a bottom of the recessed portion.

3. The liquid container according to claim 1, wherein the shock absorbing member is a shock absorbing sheet covering the opening of the recessed portion.

4. The liquid container according to claim 3, wherein the shock absorbing sheet is bonded to the inner surface on the liquid accommodation chamber side of the cover member at locations between which the recessed portion comes.

5. The liquid container according to claim 1, wherein a rib is provided to the inner surface on the liquid accommodation chamber side of the cover member opposing the plate member, on the outer side of the plate member so as to keep the plate member at a restrained position.

6. The liquid container according to claim 5, wherein the rib is provided at a position enclosing a circumference of the plate member;

wherein the recessed portion is provided to at least the inner surface on the liquid accommodation chamber side of the cover member situated inside the rib or an inner wall surface of the rib.

7. The liquid container according to claim 1, wherein the plate member is a flat plate with an outwardly curved corner portion formed at an outer circumference thereof;

wherein the recessed portion provided to the cover member is situated at a location toward which the outwardly curved corner portion moves when the plate member is impacted.

8. The liquid container according to claim 1, wherein the plate member is a flat plate with a side portion formed at an outer circumference thereof;

wherein the recessed portion provided to the cover member is situated at a location toward which the side portion moves when the plate member is impacted.

9. The liquid container according to claim 1, wherein the film is made of a flat resin sheet material and formed into a convex shape that protrudes toward a biasing direction of the spring member;

wherein the plate member is situated on an inner surface of the protruding portion of the film and has a cut-off portion at a location facing a portion of the film where the film becomes thin as a result of the forming.

10. The liquid container according to claim 9, wherein the film of the resin sheet material is formed into the convex shape so that the inner surface of the protruding portion of the film is rectangular in plan view;

wherein the plate member has a cut-off portion at a location facing a corner portion of the rectangular inner surface.

11. The liquid container according to claim 1, wherein the shock absorbing member is a shock absorbing sheet kept in its restricted position by bonded portions provided on the inner surface on the liquid accommodation chamber side of the cover member;

wherein the bonded portions are paired so that the recessed portion comes between them;

wherein a minimum distance LA between the paired bonded portions along the inner surface on the liquid accommodation chamber side of the cover member and a minimum length LB of the shock absorbing sheet present between the paired bonded portion have a relation of LA>LB.

* * * * *